US006725771B2

(12) United States Patent
Tokiwa

(10) Patent No.: US 6,725,771 B2
(45) Date of Patent: Apr. 27, 2004

(54) ROTARY PRESS SYNCHRONOUS CONTROLLER FOR SELECTING CONTROL SUBJECT BASED ON PRINT IMAGE INFORMATION

(75) Inventor: Shizurou Tokiwa, Zushi (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 213 days.

(21) Appl. No.: 09/950,018

(22) Filed: Sep. 10, 2001

(65) Prior Publication Data

US 2002/0056381 A1 May 16, 2002

(30) Foreign Application Priority Data

Sep. 22, 2000 (JP) ..... 2000-288545

(51) Int. Cl.[7] ..... B41F 5/16
(52) U.S. Cl. ..... 101/181; 101/174
(58) Field of Search ..... 101/181, 182, 101/183, 184, 185, 178–180, 136–140, 174

(56) References Cited

U.S. PATENT DOCUMENTS

| | | | | | |
|---|---|---|---|---|---|
| 4,803,634 | A | * | 2/1989 | Ohno et al. | 700/213 |
| 4,839,814 | A | * | 6/1989 | Steidel | 700/122 |
| 5,309,834 | A | | 5/1994 | Koch | 101/248 |
| 5,615,609 | A | * | 4/1997 | Hill et al. | 101/183 |
| 5,656,909 | A | * | 8/1997 | Gotz et al. | 318/625 |
| 5,873,307 | A | * | 2/1999 | Tenfelde et al. | 101/248 |
| 5,901,647 | A | * | 5/1999 | Kohlmann | 101/216 |
| 5,947,023 | A | | 9/1999 | Bohrer et al. | 101/181 |
| 6,446,553 | B1 | * | 9/2002 | Costin et al. | 101/183 |

FOREIGN PATENT DOCUMENTS

| | | |
|---|---|---|
| DE | 0 699 524 A2 | 3/1996 |
| DE | 0 699 524 A3 | 3/1996 |
| DE | 0 90 552 A3 | 7/1999 |
| DE | 0 930 552 A2 | 7/1999 |
| JP | 5-64882 | 3/1993 |
| JP | 6-47905 | 2/1994 |
| JP | 6-47905 | 6/1994 |
| JP | 8-85196 | 4/1996 |
| JP | 10-114058 | 5/1998 |
| WO | WO 97/11848 | 4/1997 |

* cited by examiner

*Primary Examiner*—Anthony H. Nguyen
(74) *Attorney, Agent, or Firm*—McGlew and Tuttle, PC

(57) ABSTRACT

To provide a synchronous controller of a rotary press for selecting a control subject based on print image information, wherein the rotary press of a multicolor printing unit has a printing division for printing a print image on the plate cylinder onto continuous paper passing between two blanket cylinders via the blanket cylinders and is constituted by combining at least two such printing divisions, and the controller has a print image allocation setting division for allocating print images to be printed to each printing couple, a driving unit for individually driving the printing couples, a slave control division for controlling rotation of the driving unit, and a master control division provided by connecting the slave control division and print image allocation setting division.

33 Claims, 11 Drawing Sheets

C: CYAN M: MAGENTA Y: YELLOW B: BLACK

ROTARY PRESS SYNCHRONOUS CONTROLLER FOR SELECTING CONTROL SUBJECT BASED ON PRINT IMAGE INFORMATION

BACKGROUND OF THE INVENTION

1. Field of the Invention

The present invention relates to a synchronous controller of a rotary press having a printing unit and other necessary units, wherein the rotary press for printing newspapers has, as a printing unit, a plurality of multicolor printing units each combining at least two printing divisions individually having two printing couples capable of printing four pages of a newspaper arranged in an axial direction, for instance, provided to be able to contact each blanket cylinder and also provided to be individually driven so as to select a drive control subject based on print image information of each printing couple.

2. Description of the Prior Art

A rotary press for individually driving printing mechanisms constituting a printing division such as a printing couple comprising a plate cylinder and blanket cylinders and a pull-in apparatus is set forth in Japanese Patent Laid-Open No. 8-85196 for instance. This bulletin describes a technology wherein a drive motor provided to individually drive the printing mechanisms and pull-in apparatus rotates with its angle of rotation controlled by a computerized motor controller, capable of mutually adjusting well and driving the individual printing mechanisms and pull-in apparatus according to proceeding of printing. In addition, this bulletin mentions that an aggregate of printing mechanisms including the pull-in apparatus can be variably combined.

Moreover, Japanese Patent Laid-Open No. 5-64882 shows the rotary press comprising units that are the printing mechanisms rendered mechanically independent so as to individually drive, and describes a technology wherein synchronized phase control is performed to the drive motor of this rotary press unit by control means. In addition, it mentions that automatic coupling among the units is simple.

Japanese Patent Laid-Open No. 6-47905 shows the rotary press having a plurality of cylinders individually driven by an electric motor and one folding apparatus individually driven, and describes a technology of simple configuration and superior in flexibility wherein a master system for operating this rotary press comprises one higher-level master system and a group of autonomous print stations separated into a plurality and assigned to the folding apparatus. It also describes a technology for allowing the group of the print stations to be assigned to the folding apparatus in any desirable manner.

Japanese Patent Laid-Open No. 10-114058 shows a synchronous controller for synchronously controlling a plurality of motors so as to keep differences in mutual phases of mechanical axes of a plurality of machines rotated and driven by the plurality of motors in a fixed relationship.

On the other hand, a multicolor printing unit of which BB printing divisions are stacked in a direction of height has an in-feed roller upstream of a first printing division and an out-feed roller downstream of a last printing division provided respectively in order to stably run the continuous paper running against gravity, so that these rollers are rotated and driven in an appropriate relationship with rotation of the printing couples of the printing unit so as to adjust traveling tension of the continuous paper.

However, the above described Japanese Patent Laid-Open No. 8-85196 does not disclose the technology for variably combining an aggregate of printing mechanisms including the pull-in apparatus. In addition, Japanese Patent Laid-Open No. 5-64882 does not disclose the technology for performing automatic coupling among the units, and Japanese Patent Laid-Open No. 6-47905 does not disclose the technology for assigning the print stations to the folding apparatus. Furthermore, Japanese Patent Laid-Open No. 10-114058 does not disclose the technology for specifying or selecting a subject to be controlled by the synchronous controller shown therein.

Meanwhile, for example in the case of newspaper printing, there is increasing use of the rotary press wherein all the printing units are multicolor printing units, that is, the so-called BB printing divisions stacked by at least two pieces and normally by four pieces in the direction of height so that a multicolor printed type page can be placed on any page and complicated form feed is not required whichever page the multicolor printed type page is placed.

However, a newspaper of which all pages are the multicolor printed type pages is seldom published for various reasons. Accordingly, there may be a printing division not required to operate when actually printing the newspaper, and so it has been requested with increasing eagerness that printing should be performed while stopping the printing division not required to operate, that is, the printing division that may be stopped, from the viewpoints of energy saving, reduction of running costs and also improved work safety.

However, in the case where a worker specifies the printing division to be stopped each time, it often happens that specification of the printing division to be specified is forgotten so that there arises inconvenience to implementation of the desired energy saving, reduction of running costs and also improved work safety, and there were cases where it caused a slowdown of the work, though very rarely, by specifying a printing division not to be specified and consequently producing faulty printed matter and causing trouble in the printing process.

For that reason, a rational apparatus capable of securely specifying the printing division without error has been desired.

On the other hand, there are the cases, in newspaper printing, where less than six pages are printed by a printing machine capable of printing total eight pages on both sides by arranging machine plates equivalent to four newspaper pages in an axial direction. In this case, as the continuous paper of a width fit for the number of pages to be printed is used for printing, it is necessary to change a tension range of the traveling direction worked on the continuous paper by the in-feed roller and out-feed roller in order for the continuous paper to travel in a stable state in the printing unit, and the rational apparatus capable of securely making the change without error has been desired.

SUMMARY OF THE INVENTION

An object of the present invention is to provide a synchronous controller of a rotary press for selecting a control subject based on print image information by automatically selecting a printing division not required to operate, that is, the printing division that may be stopped and excluding it from subjects of synchronous operation control, and thus capable of energy saving and reduction of running costs.

Another object of the present invention is to provide a synchronous controller of a rotary press for selecting a control subject based on print image information by recognizing a width dimension of the continuous paper required by each multicolor printing unit based on the print image information, and capable of automatically setting a reference tension on traveling of the continuous paper in advance of printing operation based on the recognition, having the continuous paper travel stably from a start of printing operation according to the reference tension, and preventing malfunctions such as a paper drift wherein the continuous paper moves from side to side while traveling due to an unstable tension, occurrence of wrinkles in the traveling direction and paper out.

A further object of the present invention is to provide a synchronous controller of a rotary press for selecting a control subject based on print image information, capable of, even if a master control division suffers a breakdown, synchronously controlling the rotary press with another master control division.

A still further object of the present invention is to provide a loop-like network line capable of bypassing a part of the network line suffering a breakdown, if any.

A still further object of the present invention is to provide a master control division for setting a driving reference phase and a driving reference speed, processing information inputted from an input operation division and a print image allocation setting division to operate other components, generating an separation signal for separating two blanket cylinders excluded from the operation control subjects, and thus capable of energy saving and reduction of running costs.

A still further object of the present invention is to provide a master control division for setting a driving reference phase and a driving reference speed, processing information inputted from an input operation division and a print image allocation setting division to operate other components, generating an separation signal for separating two blanket cylinders excluded from the operation control subjects, selecting a paper width of the continuous paper to be printed by each multicolor printing unit to be controlled, having the continuous paper travel stably according to the reference tension, and capable of preventing malfunctions such as a paper drift wherein the continuous paper moves from side to side while traveling due to an unstable tension, occurrence of wrinkles in the traveling direction and paper out.

A still further object of the present invention is to provide a print image allocation setting division wherein, from inputted information, information on allocation of pages to be printed respectively and allocation of print images to be printed on each printing couple of a specified multicolor printing unit is set in respective axial areas of the right and left printing cylinders of each specified multicolor printing unit.

A still further object of the present invention is to provide a print image allocation setting division wherein print image allocation patterns are prepared in advance and allocation information of print images to be printed on each printing couple of a specified multicolor printing unit is set.

A still further object of the present invention is to provide a processing division for generating a separation signal for separating two blanket cylinders forming a printing division from the sum of "numbers" of values based on whether or not there is an image to be printed from the print image allocation information.

A still further object of the present invention is to provide to each multicolor printing unit, from the print image allocation information, a processing division for recognizing an unnecessary area of the continuous paper based on whether or not there is an image to be printed in each predetermined corresponding area of the right and left printing cylinders, and also selecting a paper width of the continuous paper required as the continuous paper of the multicolor printing unit.

A still further object of the present invention is to provide a message and configuration thereof for specifying a management range of rotary press set formation for printing operation based on the allocation information from the print image allocation setting division.

A still further object of the present invention is to provide a controlling message and configuration thereof related to width information of the continuous paper to be printed by each multicolor printing unit selected by the processing division, a driving reference value set by a driving reference setting division and so on.

A still further object of the present invention is to provide an out-feed control division and an in-feed control division for having the continuous paper travel stably according to the reference tension based on information from the master control division, and capable of preventing malfunctions such as a paper drift wherein the continuous paper moves from side to side while traveling due to an unstable tension, occurrence of wrinkles in the traveling direction and paper out.

In the disclosed embodiment, the rotary press having a plurality of multicolor printing units combining at least two of so-called BB printing divisions wherein a blanket cylinder of a printing couple combining a plate cylinder and the blanket cylinder in a contactable manner is placed in a contactable manner with a blanket cylinder of another printing couple for printing a print image on the plate cylinder onto continuous paper passing between the two blanket cylinders via the blanket cylinders, for using and printing on, in each of these multicolor printing units, the continuous paper of a width dimension selected from the predetermined continuous paper of several width dimensions according to a print image area of the multicolor printing unit, said rotary press having: a print image allocation setting division for allocating to each printing couple a print image to be printed by the printing couple; driving means placed on each printing couple for individually driving the printing couples; an in-feed roller corresponding to each multicolor printing unit and rotated and driven by individual driving means to feed the multicolor printing unit with the continuous paper; a dancer roller corresponding to each multicolor printing unit and displaced according to traveling tension of the continuous paper fed into the multicolor printing unit and a force set to go against the traveling tension; an out-feed rollers corresponding to each multicolor printing unit and rotated and driven by individual driving means to draw out the continuous paper from the multicolor printing unit; a tension detection roller corresponding to each multicolor printing unit and detecting the traveling tension of the continuous paper drawn out of the multicolor printing unit; a slave control division provided to each driving means for controlling rotation of the driving means; an in-feed control division for controlling the rotation and driving of the in-feed roller according to the displacement of the dancer roller; an out-feed control division for controlling the rotation and driving of the out-feed roller according to the traveling tension of the continuous paper detected by the tension detection roller; one or more master control divisions provided by connecting with each slave control division, each in-feed control division each out-feed control division and the print image allocation setting division; and contact and separation means for, on receiving a separation signal from the master control division, separating the two blanket cylinders of the printing couple; and wherein the master control division is configured so that it specifies the slave control division, in-feed control division and out-feed control division to be managed based on allocation information of the print image allocation setting division, sends a control reference signal to the specified slave control division, sends to the specified in-feed control division a signal for setting the force to go against the traveling tension of the dancer roller corresponding to the continuous paper of a width dimension selected according to the print image area based on allocation information of the print image allocation setting division, and sends to the specified out-feed control division a signal for setting the detection tension of the tension detection roller for controlling rotation and driving of the out-feed roller corresponding to the continuous paper of a width dimension selected according to the print image area based on allocation information of the print image allocation setting division.

DETAILED DESCRIPTION OF PREFERRED EMBODIMENTS

Figure 1:
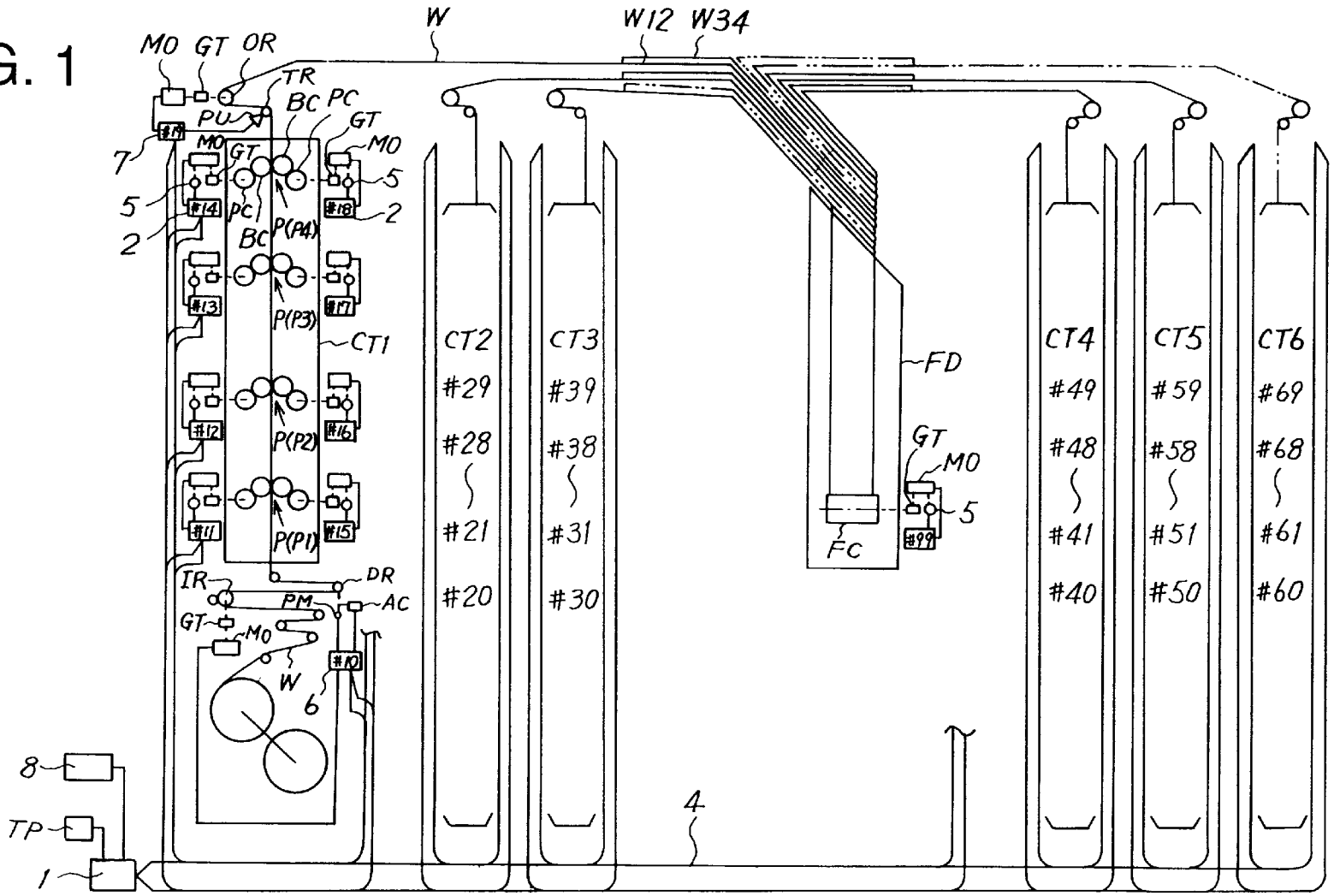
FIG. 1 is a schematic block diagram of a newspaper printing rotary press to which an embodiment of the present invention is applied.
Figure 2:
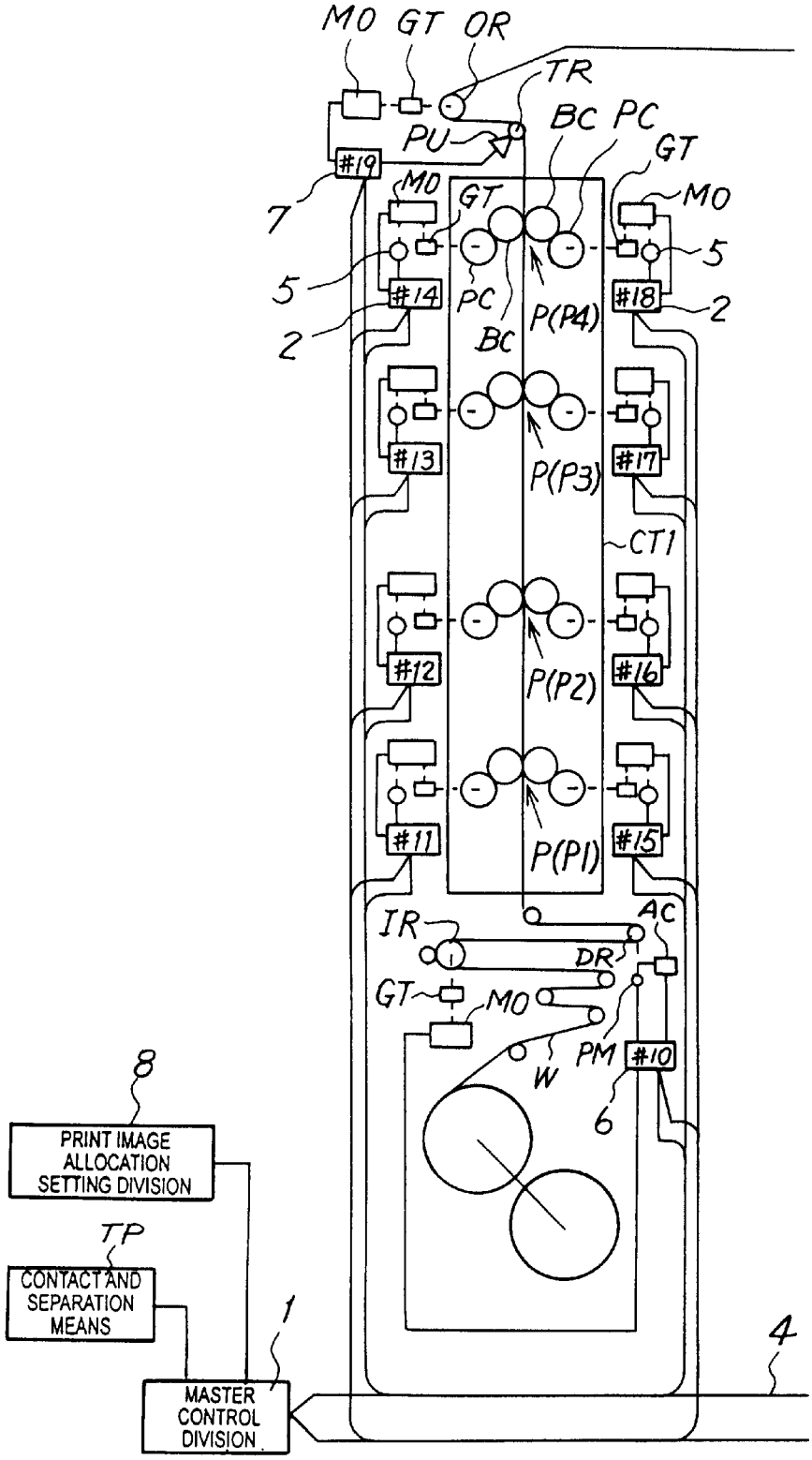
FIG. 2 is an enlarged view of a part of FIG. 1.

FIG. 1 is a schematic block diagram of a newspaper printing rotary press to which an embodiment of the present invention is applied, and FIG. 2 is an enlarged view of a part of FIG. 1.

In FIG. 1 and FIG. 2, the rotary press has multicolor printing units CT1 to CT6 having four printing divisions P (P1, P2, P3 and P4) respectively and a folding unit FD for cutting and folding printed continuous paper W by predetermined print images.

Each printing division P has two sets of printing couples each combining a plate cylinder PC and a blanket cylinder BC in a contactable manner provided so that each blanket cylinder BC is contactable, and in the case of the newspaper printing rotary press, for instance, the printing couples have a width capable of printing four pages of a newspaper side by side.

And it is configured so that the continuous paper W printed across the width is divided at the center of the width, and divided paper W34 printed in the third area and the fourth area (see FIGS. 7 and 8) of a printing cylinder (hereafter, when collectively referring to both the plate cylinder PC and blanket cylinder BC or when not necessary to identify which of the two, it is referred to as a "printing cylinder") of the printing division P is placed fitly by a turn bar apparatus (unillustrated) on divided paper W12 printed in the first area and the second area (see FIGS. 7 and 8) of the printing cylinder of the printing division P, and besides, all the divided paper W12 and divided paper W34 printed in the multicolor printing units CT1 to CT6 are placed fitly one on another, which is then guided to the folding unit FD to make a newspaper.

Each printing couple has driving means MO drive the plate cylinder PC via gear transmission means GT and the blanket cylinder BC via the gear transmission means provided on the plate cylinder PC and between the plate cylinder PC and the blanket cylinder BC.

The above described folding unit FD has the driving means MO drive the folding cylinder FC via gear transmission means GT and another cylinder via the gear transmission means provided between the folding cylinder FC and another cylinder. Moreover, it may have a configuration wherein an output axis of the driving means MO directly drives the plate cylinder PC or the folding cylinder FC by eliminating the gear transmission means GT involved between the driving means MO and the plate cylinder PC or the folding cylinder FC.

Each of the multicolor printing units CT1 to CT6 has an in-feed roller IR upstream of the first printing divisions P1 and an out-feed roller OR downstream of the last printing divisions P4 respectively, and the in-feed roller IR and out-feed roller OR are both provided to be driven by the individual driving means MO via the gear transmission means GT. Moreover, it may also have a configuration wherein the output axis of the driving means MO directly drives the in-feed roller IR or the out-feed roller OR by eliminating the gear transmission means GT involved between the driving means MO and the in-feed roller IR or the out-feed roller OR.

A dancer roller DR is provided between the in-feed roller IR and the first printing divisions P1. The dancer roller DR is given by counterforce providing means AC such as an air cylinder for instance, predetermined force to go against the traveling tension of the continuous paper W fed by the in-feed roller IR into the multicolor printing units CT1 to CT6, and is displaced according to the traveling tension of the continuous paper W and the counterforce thereto.

The above described dancer roller DR will have detection means PM for detecting displacement thereof. For instance, a potentiometer that changes an output value according to the displacement of the dancer roller DR is used as the detection means PM.

A tension detection roller TR is provided between the out-feed roller OR and the last printing division P4. The tension detection roller TR has tension detection means PU annexed so as to detect the traveling tension of the continuous paper W drawn out of the multicolor printing units CT1 to CT6 by the out-feed roller OR.

Figure 4:
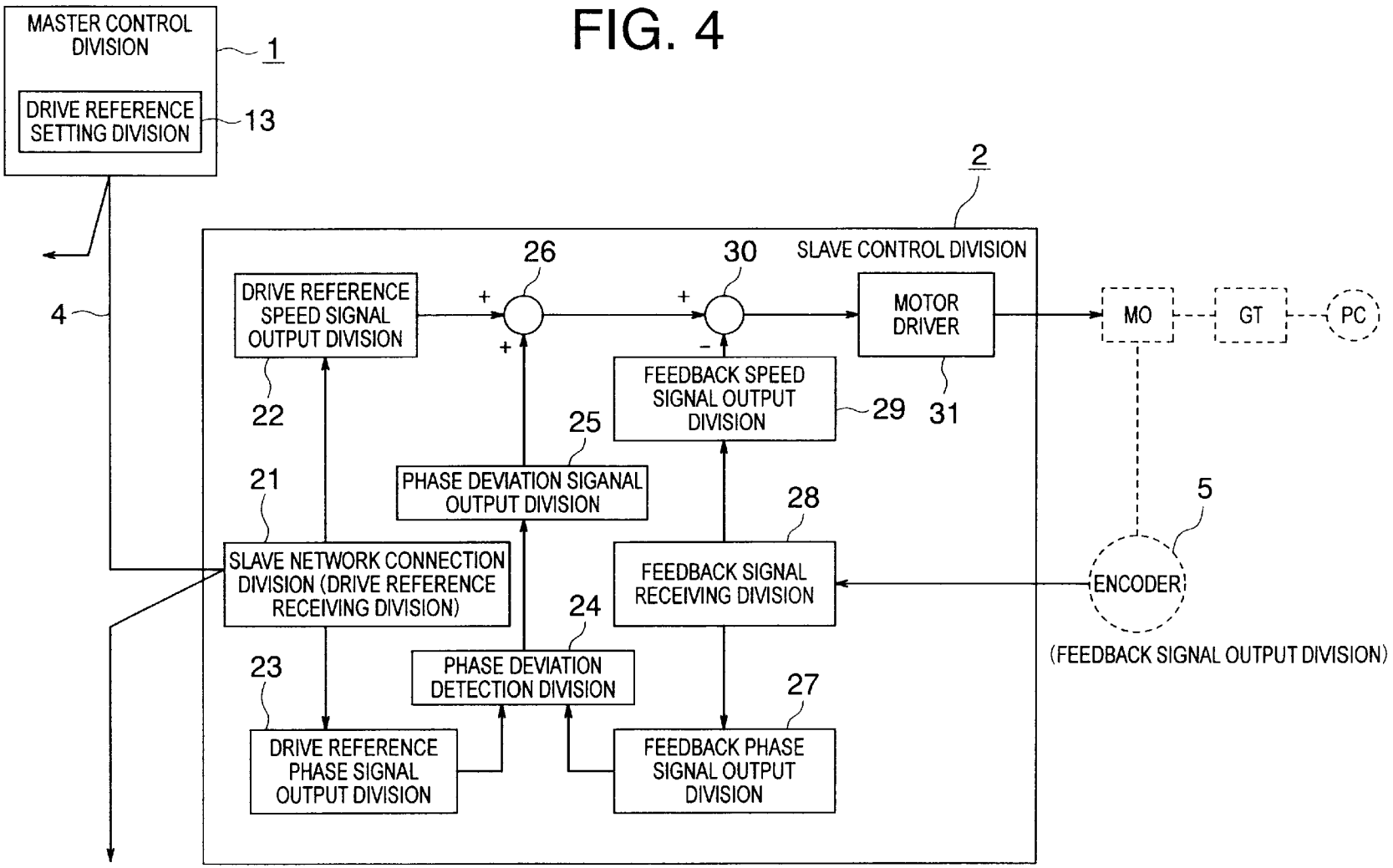
FIG. 4 is a block diagram showing an embodiment of a slave control division.

The driving means MO of the above described printing couple and the driving means MO of the folding unit FD have the slave control divisions 2 of #11 to #18, #21 to #28, #31 to #38, #41 to #48, #51 to #58, #61 to #68 and #99 corresponding to these driving means MO and rotary encoders (hereafter, the encoders) 5 with a Z phase outputting a pulse signal for each angular displacement of a predetermined angle and also outputting a Z-phase pulse signal for each rotation provided, where the slave control divisions 2 are connected to a network line 4 via a slave network connection division 21 explained in FIG. 4 (connection forms of the slave control divisions 2 of #15 to #18, #21 to #28, #31 to #38, #41 to #48, #51 to #58, #61 to #68 and #99 and the network line 4 are unillustrated since they are the same as those of the slave control divisions 2 of #11 to #14).

Figure 5:
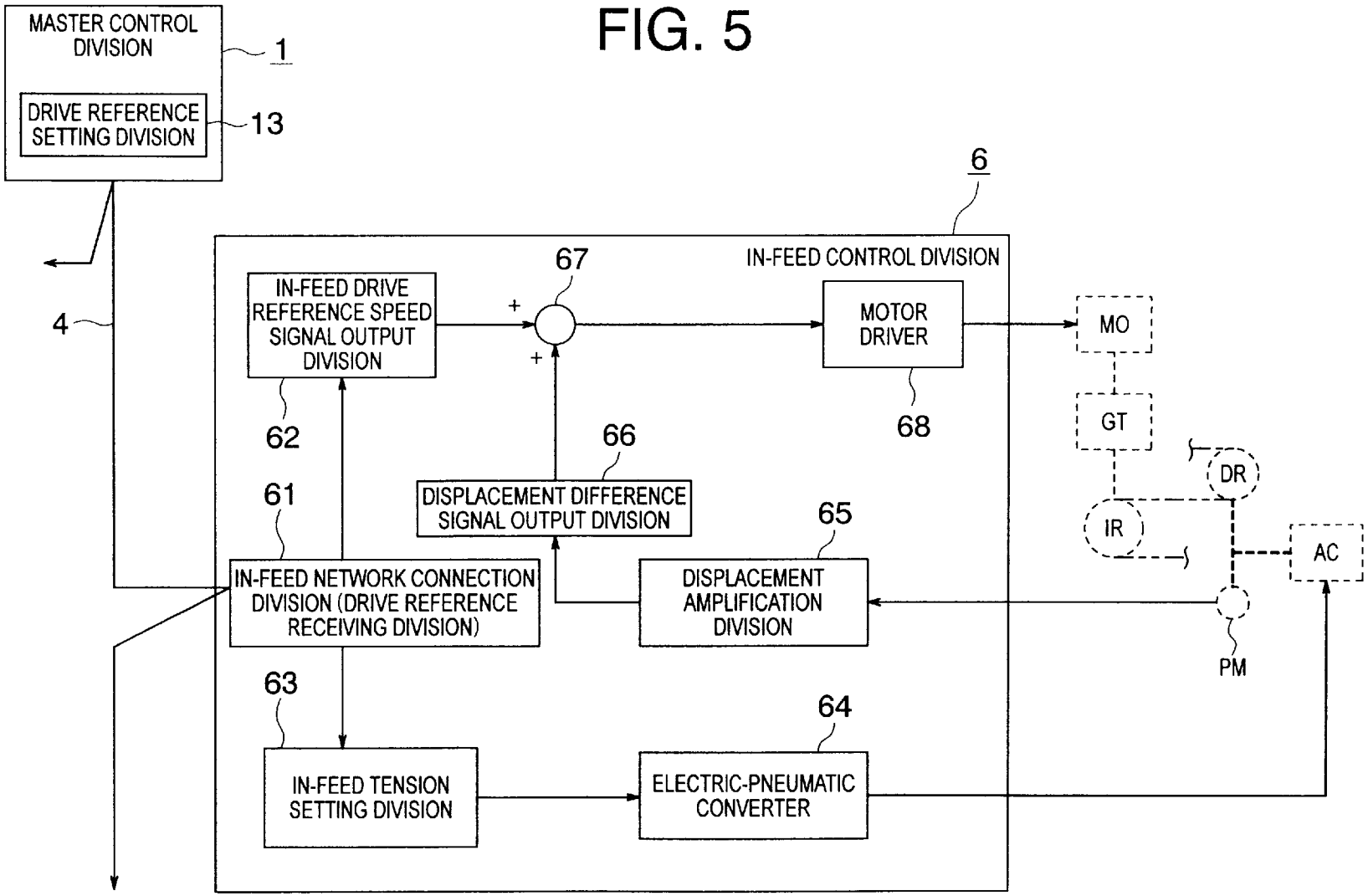
FIG. 5 is a block diagram showing an embodiment of an in-feed control division.

The driving means MO of the above described in-feed roller IR has in-feed control divisions 6 of #10, #20, #30, #40, #50 and #60 corresponding to the driving means MO of each in-feed roller IR provided, and the in-feed control divisions 6 are connected to the network line 4 via an in-feed network connection division 61 explained in FIG. 5 (connection forms of the in-feed control divisions 6 of #20, #30, #40, #50 and #60 and the network line 4 are unillustrated since they are the same as that of the in-feed control division 6 of #10).

Figure 6:
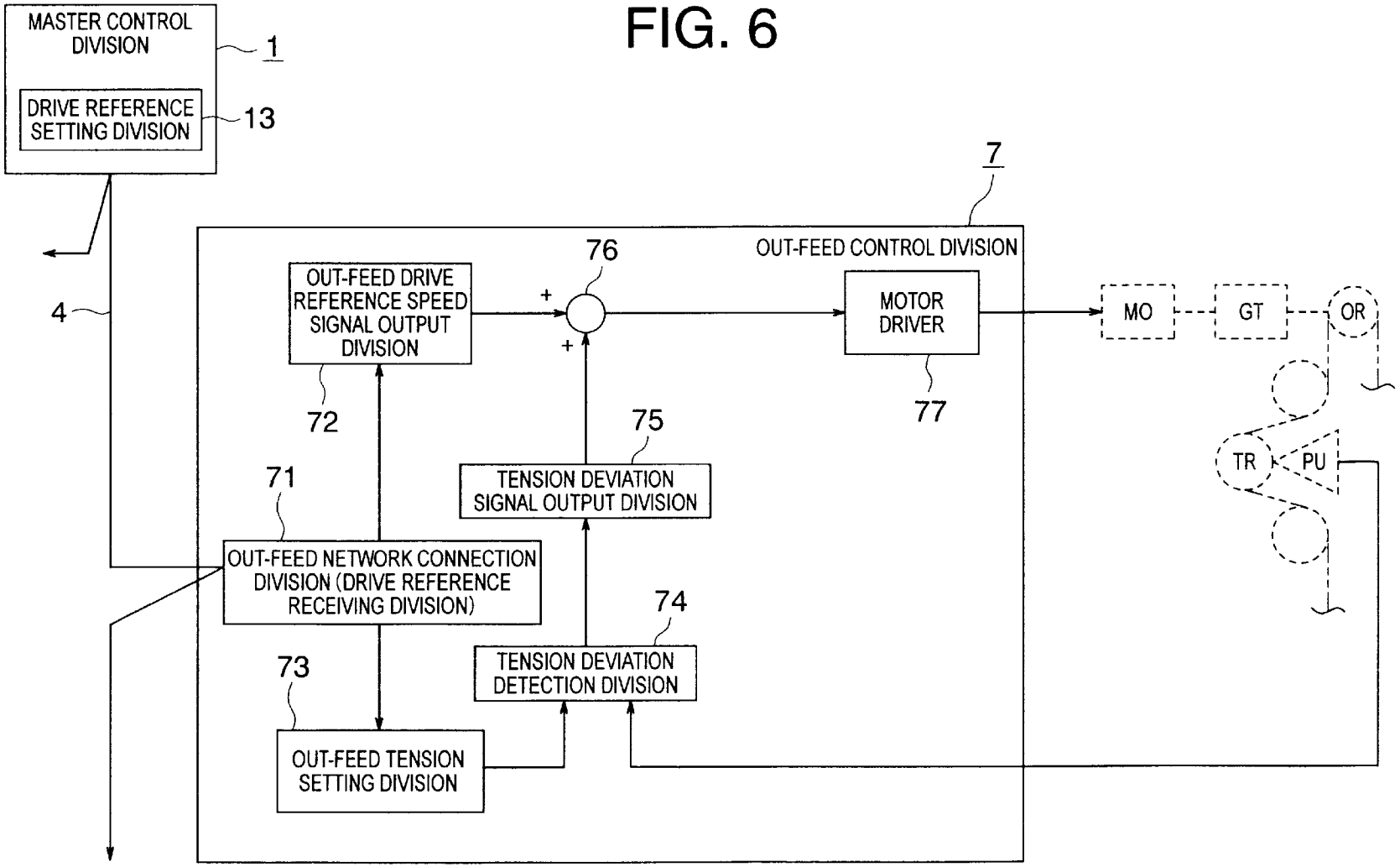
FIG. 6 is a block diagram showing an embodiment of an out-feed control division.

The driving means MO of the above described out-feed roller OR has out-feed control divisions 7 of #19, #29, #39, #49, #59 and #69 corresponding to each driving means MO provided, and the out-feed control divisions 7 are connected to the network line 4 via an out-feed network connection division 71 explained in FIG. 6 (connection forms of the out-feed control divisions 7 of #29, #39, #49, #59 and #69 and the network line 4 are unillustrated since they are the same as that of the out-feed control division 7 of #19).

In addition, this network line 4 is connected with a master control division 1. Moreover, it may also have a configuration wherein a plurality of the master control divisions are provided instead of the master control division 1, each having functions of the master control division described later, and capable of selectively switching and using the master control divisions.

The network line 4 is formed in a loop-like manner, and is configured so that, even if one side thereof becomes blocked due to any trouble, signal transmission by the other side is possible between the master control division 1 and the slave control divisions 2 of #11 to #18, #21 to #28, #31 to #38, #41 to #48, #51 to #58, #61 to #68 and #99, the in-feed control divisions 6 of #10, #20, #30, #40, #50 and #60 and the out-feed control divisions 7 of #19, #29, #39, #49, #59 and #69.

Figure 3:
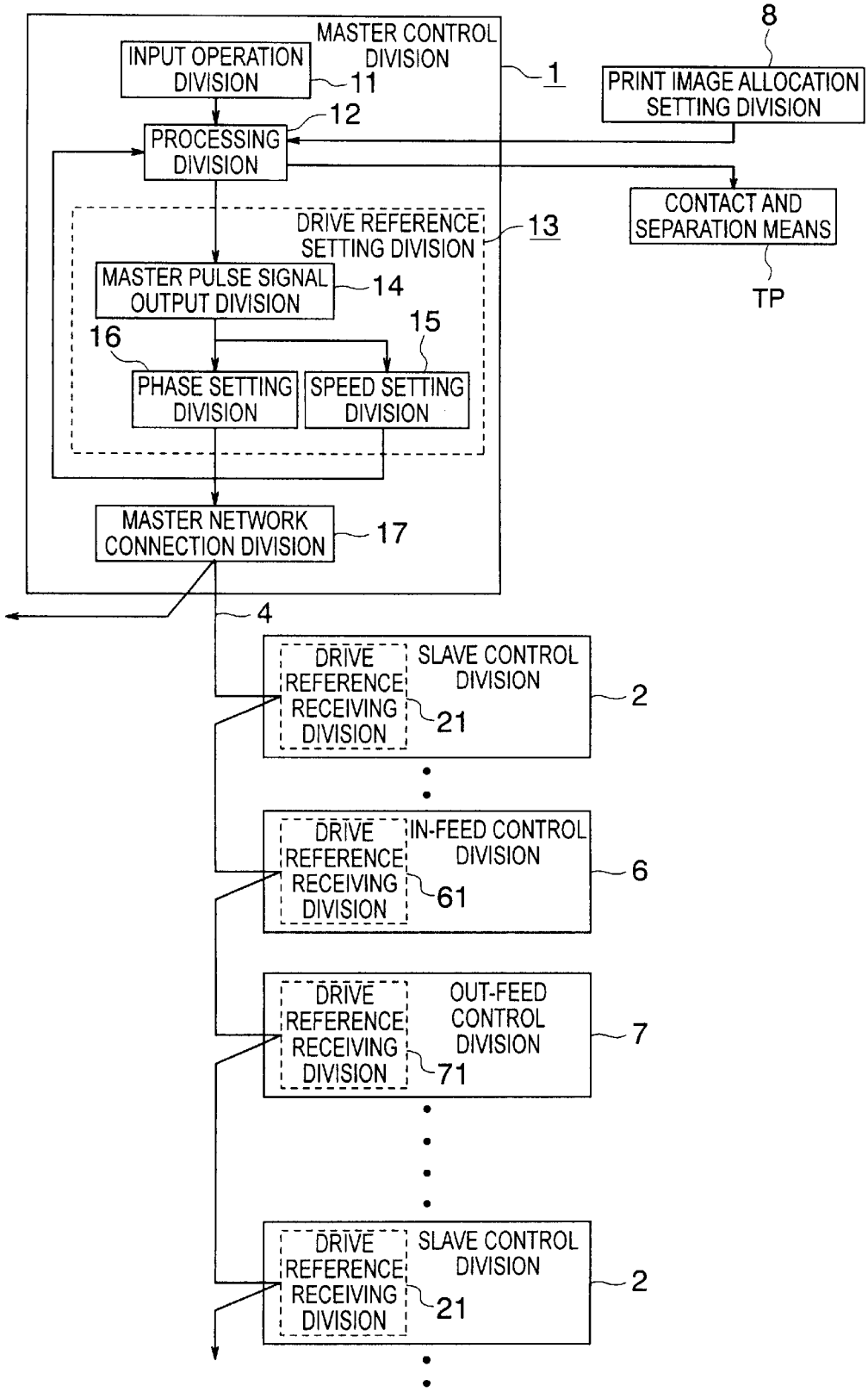
FIG. 3 is a block diagram showing an embodiment of a master control division.

FIG. 3 is a block diagram showing an embodiment of the master control division 1.

In FIG. 3, the master control division 1 has an input operation division 11, a driving reference setting division 13, a processing division 12 and a master network connection division 17. In addition, the master control division 1 is connected with two blanket cylinders BC forming a print image allocation setting division 8 and each printing division P and contact and separation means TP of BC.

The input operation division 11 is capable of operations of inputting at least operation signals of start, acceleration and deceleration, stop and so on.

The processing division 12 receives allocation information from the print image allocation setting division 8, and organizes a set of the rotary press for printing operation this time and creates a message for specifying a management range based on the allocation information, and also allows operations from the above described input operation division 11 and driving reference setting based on these operations so as to enable synchronous control of the organized set. In addition, the processing division 12 selects a width of the continuous paper W to be printed by the multicolor printing units CT1 to CT6 based on the allocation information. Apart from it, it also sends an operation signal to the contact and separation means TP.

The master network connection division 17 sends to the network line 4 a message for specifying a management range created by the processing division 12, and also sends to the network line 4 a controlling message related to width information of the continuous paper W, a driving reference value set by the driving reference setting division 13 and so on, and receives response messages sent from the slave control division 2, the in-feed control divisions 6 and the out-feed control divisions 7 via the network line 4.

The above described driving reference setting division 13 has a master pulse signal output division 14, a speed setting division 15 and a phase setting division 16.

The master pulse signal output division 14 outputs a first master pulse signal in proportion to a speed value set by the processing division 12 based on operation signals such as start, acceleration and deceleration and stop inputted by the input operation division 11 and outputs a second master pulse signal each time a predetermined number of the first master pulse signals are outputted. The first and second master pulse signals are the signals of frequencies equal to the pulse signals outputted by the encoder 5 provided corresponding to each driving means MO and Z-phase pulse signals outputted by the encoder 5.

The speed setting division 15 sets a driving reference speed of the driving means MO based on the first master pulse signal outputted by the master pulse signal output division 14.

The phase setting division 16 sets a driving reference phase of the printing cylinders driven by the driving means MO, that is, the plate cylinder PC for instance, based on the first and second master pulse signals outputted by the master pulse signal output division 14.

FIG. 4 is a block diagram showing an embodiment of a slave control division.

In FIG. 4, the slave control division 2 has the slave network connection division 21 also serving as a driving reference receiving division, a driving reference speed signal output division 22, a driving reference phase signal output division 23, a feedback signal receiving division 28, a feedback speed signal output division 29, a feedback phase signal output division 27, a phase deviation detection division 24, a phase deviation signal output division 25, a first speed signal correction division 26, a second speed signal correction division 30 and a motor driver 31.

The slave network connection division 21 is a microcomputer including an interface, and receives via the network line 4 a message for specifying a management range consisting of set organization information sent by the master control division 1 and the controlling messages such as driving references that are the driving reference speed and driving reference phase, and sends to the master control division 1 the response message notifying receipt of the message from the master control division 1 as required.

The driving reference speed signal output division 22 converts the driving reference speed of the controlling message into the driving reference speed signal of an analog signal in proportion to the speed value set by the above described processing division 12 based on an input signal inputted from the above described input operation division 11.

The driving reference phase signal output division 23 has the driving reference phase of the controlling message inputted. And each time the driving reference phase is inputted, it corrects the phase, based on a paper feed path length from the printing couple driven by the driving means MO corresponding to the slave control division 2 to a cutting position of the folding unit FD and an assembling phase of the plate cylinder PC of the printing couple and the encoder 5 via the driving means MO, to an extent predetermined so that the print image printed by the printing couple will be in a correct relationship with the position cut by the folding unit FD, and outputs the corrected phase by an appropriate signal as the driving reference phase. Moreover, the driving reference phase signal output division 23 of the slave control division 2 of #99 for controlling the driving means MO of the folding cylinder FC of the folding unit FD outputs the inputted driving reference phase by an appropriate signal as the driving reference phase.

The feedback signal receiving division 28 receives the pulse signal and the Z-phase pulse signal outputted by the encoder 5 corresponding to the driving means MO. The feedback speed signal output division 29 computes a value in proportion to a rotating speed of the driving means MO based on the pulse signal outputted by the encoder 5, and further converts it into the driving speed signal that is an analog signal in proportion to the rotating speed of the driving means MO and outputs it.

The feedback phase signal output division 27 detects, from the pulse signal outputted by the encoder 5, a rotation phase of the printing cylinder such as the plate cylinder PC, which is a driven portion, and outputs it by an appropriate signal.

The phase deviation detection division 24 detects deviation of the printing cylinder phase against the driving reference phase from the driving reference phase signal outputted by the driving reference phase signal output division 23 and the phase signal of the printing cylinder (such as the plate cylinder PC) outputted by the feedback phase signal output division 27.

The phase deviation signal output division 25 is a proportional integral amp, and converts the deviation detected by the phase deviation detection division 24 into the phase deviation signal of an analog signal and outputs it.

The first speed signal correction division 26 corrects the driving reference speed signal outputted by the driving reference speed signal output division 22 by the phase deviation signal outputted by the phase deviation signal output division 25. The second speed signal correction division 30 corrects a first correction speed signal after being corrected in the first speed signal correction division 26 by the driving speed signal of the driving means MO outputted by the feedback speed signal output division 29.

The motor driver 31 supplies driving power to the driving means MO under its control based on a second correction speed signal after being corrected by the second speed signal correction division 30.

FIG. 5 is a block diagram showing an embodiment of the in-feed control division.

In FIG. 5, the in-feed control division 6 has the in-feed network connection division 61 also serving as a driving reference receiving division, an in-feed driving reference speed signal output division 62, an in-feed tension setting division 63, an electric pneumatic converter 64, displacement amplifier 65, displacement difference signal output division 66, an in-feed speed signal correction division 67 and a motor driver 68.

The in-feed network connection division 61 is a microcomputer including an interface, and receives via the network line 4 the message for specifying a management range consisting of set organization information and the controlling messages such as driving references that are the driving reference speed and driving reference phase sent by the master control division 1, and sends to the master control division 1 the response message notifying receipt of the message from the master control division 1 as required. Moreover, the driving reference that the in-feed network connection division 61 receives may be nothing but the driving reference speed.

The in-feed driving reference speed signal output division 62 converts the driving reference speed of the controlling message received by the in-feed network connection division 61 into the driving reference speed signal that is an analog voltage signal in proportion to the speed value set by the above described processing division 12 based on an input signal inputted from the above described input operation division 11, and outputs it.

Based on the paper width information on the continuous paper W received by the in-feed network connection division 61, the in-feed tension setting division 63 selects a reference tension of the continuous paper W traveling downstream of the in-feed roller IR from values predetermined corresponding to such information, and sets it as an in-feed tension. And in order to set at a value corresponding to the set in-feed tension an output pressure of the air cylinder that is counterforce providing means AC for giving counterforce to go against the traveling tension of the continuous paper W to the dancer roller DR displaced according to the traveling tension of the continuous paper W by way of the in-feed roller IR, it outputs an electric power signal corresponding to an input pressure to the above described air cylinder for the sake of acquiring that output pressure.

The electric pneumatic converter 64 adjusts pressure of compressed air to be supplied to the air cylinder that is counterforce providing means AC based on the electric power signal outputted by the in-feed tension setting division 63.

The displacement amplifier 65 receives a displacement signal from the detection means PM for detecting a displacement amount of the in-feed roller IR arising from a difference between the traveling tension of the continuous paper W traveling downstream of the in-feed roller IR and the in-feed tension set by the in-feed tension setting division 63, and outputs an amplified voltage signal commensurate therewith.

The displacement difference signal output division 66 compares an output signal of the displacement amplifier 65 with the amplified voltage signal commensurate with the displacement signal of the detection means PM when the in-feed roller IR is at a reference position, and outputs the difference as a displacement difference signal.

The in-feed speed signal correction division 67 corrects the driving reference speed signal that is an analog voltage signal outputted by the in-feed driving reference speed signal output division 62 by the displacement difference signal outputted by the displacement difference signal output division 66.

The motor driver 68 supplies the driving power to the driving means MO of the in-feed roller IR based on the correction speed signal corrected by the in-feed speed signal correction division 67.

FIG. 6 is a block diagram showing an embodiment of the out-feed control division.

In FIG. 6, the out-feed control division 7 has the out-feed network connection division 71 also serving as a driving reference receiving division, an out-feed driving reference speed signal output division 72, an out-feed tension setting division 73, a tension deviation detection division 74, a tension deviation signal output division 75, an out-feed speed signal correction division 76 and a motor driver 77.

The out-feed network connection division 71 is a microcomputer including an interface, and receives via the network line 4 the message for specifying a management range consisting of set organization information and the controlling messages such as driving references that are the driving reference speed and driving reference phase sent by the master control division 1, and sends to the master control division 1 the response message notifying receipt of the message from the master control division 1 as required. Moreover, the driving reference that the out-feed network connection division 71 receives may be nothing but the driving reference speed.

The out-feed driving reference speed signal output division 72 converts the driving reference speed of the controlling message received by the out-feed network connection division 71 into the driving reference speed signal that is an analog voltage signal in proportion to the speed value set by the above described processing division 12 based on an input signal inputted from the above described input operation division 11, and outputs it.

Based on the paper width information on the continuous paper W received by the out-feed network connection division 71, the out-feed tension setting division 73 selects a reference tension of the continuous paper W traveling upstream of the out-feed roller OR from values predetermined corresponding to such information, and sets it as an out-feed tension and outputs it by an appropriate signal.

The tension deviation detection division 74 detects, from the out-feed tension outputted by the out-feed tension setting division 73 and the traveling tension of the continuous paper W traveling upstream of the out-feed roller OR detected by the tension detection means PU annexed to the tension detection roller TR, a deviation of the traveling tension of the continuous paper W traveling upstream of the out-feed roller OR against the out-feed tension.

The tension deviation signal output division 75 is a proportional integral amp, and converts the deviation detected by the tension deviation detection division 74 into the tension deviation signal that is an analog voltage signal and outputs it.

The out-feed speed signal correction division 76 corrects the driving reference speed signal that is an analog voltage signal outputted by the out-feed driving reference speed signal output division 72 by the tension deviation signal outputted by the tension deviation signal output division 75.

The motor driver 77 supplies the driving power to the driving means MO of the out-feed roller OR based on the correction speed signal corrected by the out-feed speed signal correction division 76.

Next, the case of implementing operation of the synchronous controller of the rotary press related to the present invention in the newspaper rotary press capable of printing print images equivalent to four pages of a newspaper arranged side by side in an axial direction of the plate cylinder PC will be described.

Prior to printing operation of the rotary press, information on the print image to be printed this time is set in the print image allocation setting division 8, that is, in which area of which printing couple of which multicolor printing unit the image is to be printed. For instance, in the case where a newspaper of 36 pages in total and printing color of each page as shown in Table 1 is printed by specifying the multicolor printing units CT1 to CT6, this print image allocation information is set by inputting "unit specification information" that specifies the "CT1," "CT2," "CT3," "CT4," "CT5," "CT6" as the multicolor printing units to be specified and the "FD" as a folding unit to be specified, "page number information" that specifies "36" as the total number of pages of the newspaper to be printed and "printing color information" that specifies the printing color of each page.

When inputting the "printing color information," in the case of printing each page in the printing color as shown in Table 1, it is inputted as, for instance, "1CMYB: 2B: 3CYB: 4B: 5B: . . . : 36CMYB." Moreover, the numbers of the printing color information indicates the number of pages, and the alphabet indicates the printing color, that is, C indicates cyan, M magenta, Y yellow and B black.

TABLE 1

| Page No. | Print color | Page No. | Print color | Page No. | Print color |
|---|---|---|---|---|---|
| 1 | Cyan<br>Magenta<br>Yellow<br>Black | 13 | Black | 25 | Magenta<br>Black |
| 2 | Black | 14 | Black | 26 | Black |
| 3 | Cyan<br>Yellow<br>Black | 15 | Black | 27 | Black |
| 4 | Black | 16 | Black | 28 | Black |
| 5 | Black | 17 | Cyan<br>Magenta<br>Yellow<br>Black | 29 | Black |
| 6 | Black | 18 | Cyan<br>Magenta<br>Yellow<br>Black | 30 | Black |
| 7 | Black | 19 | Cyan<br>Magenta<br>Yellow<br>Black | 31 | Black |
| 8 | Black | 20 | Cyan<br>Magenta<br>Yellow<br>Black | 32 | Magenta<br>Black |
| 9 | Magenta<br>Yellow<br>Black | 21 | Black | 33 | Black |
| 10 | Black | 22 | Cyan<br>Black | 34 | Cyan<br>Yellow<br>Black |
| 11 | Black | 23 | Cyan<br>Yellow<br>Black | 35 | Black |
| 12 | Magenta<br>Yellow<br>Black | 24 | Black | 36 | Cyan<br>Magenta<br>Yellow<br>Black |

Figure 7:
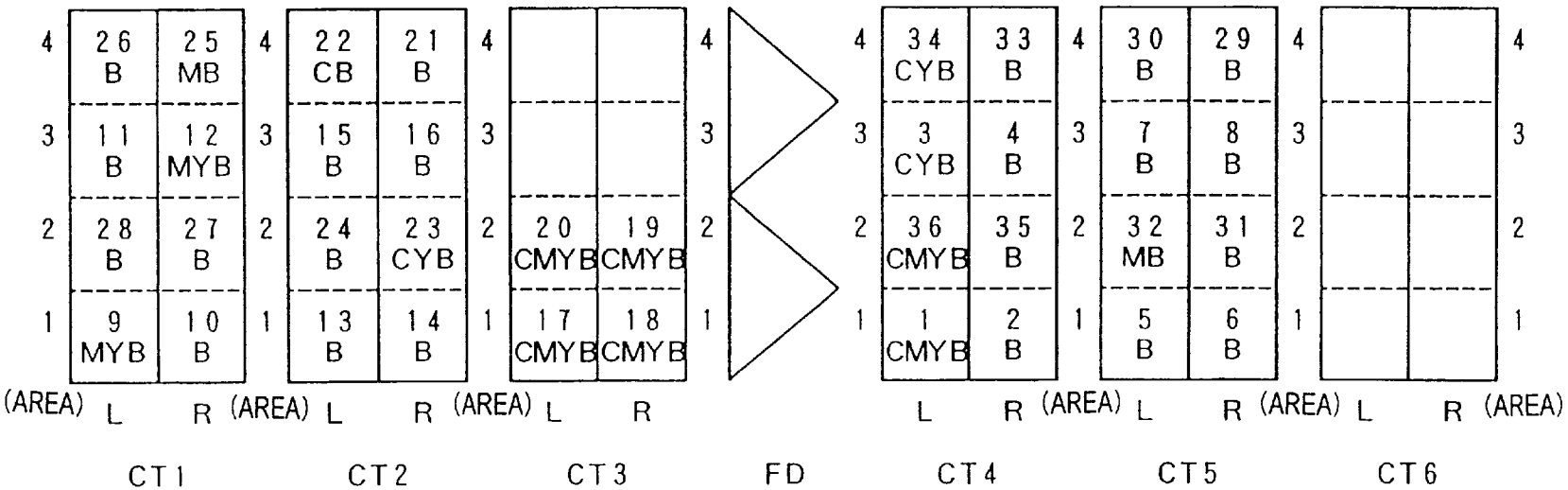
FIG. 7 is a diagram explaining printing "pages" allocated to the right and left printing cylinders of each multicolor printing unit when printing a newspaper of 36 pages by a rotary press of six multicolor printing units on the assumption that each page has printing color according to Table 1.
Figure 8:
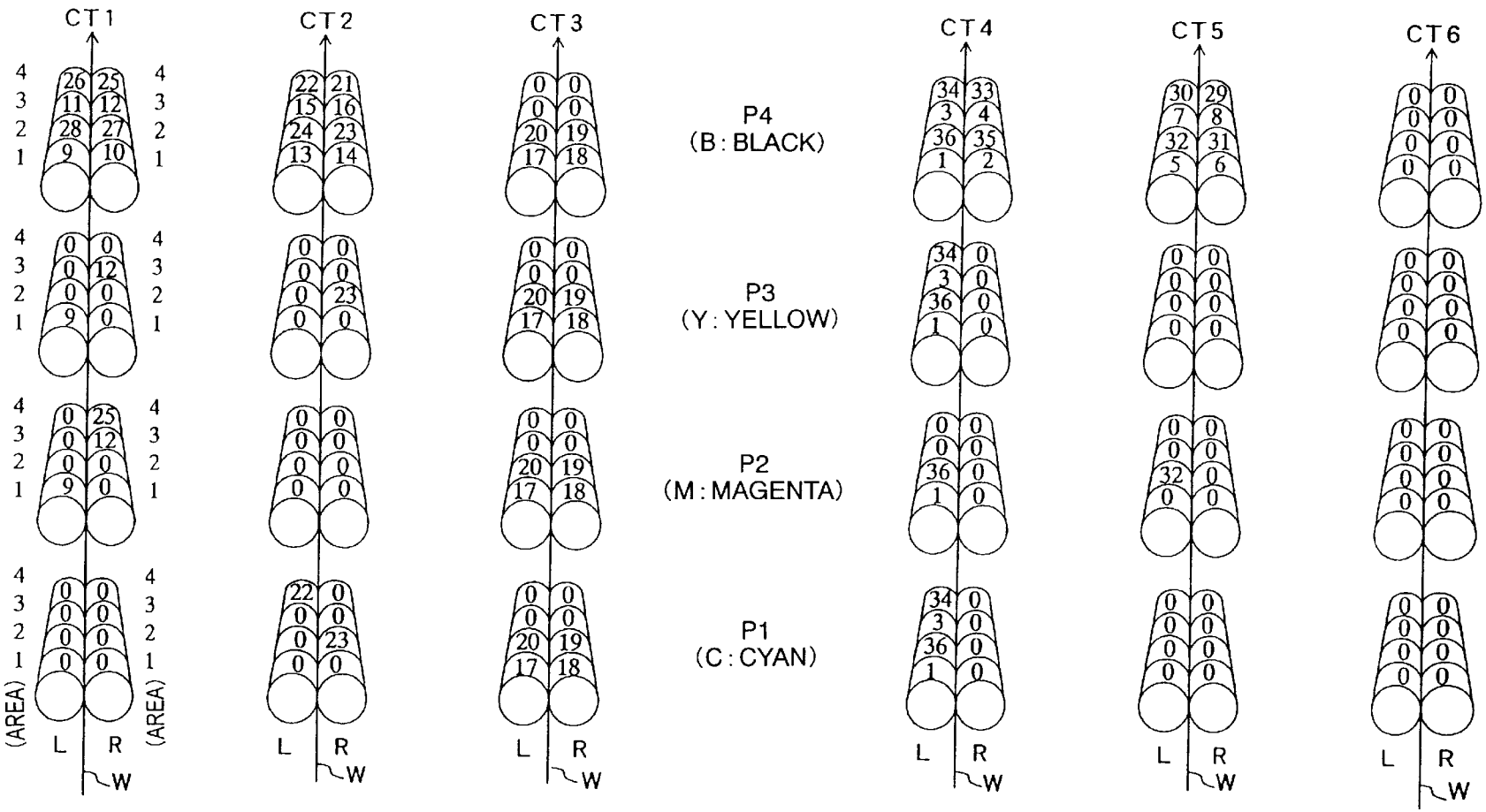
FIG. 8 is a diagram showing printing "pages" to which "the pages" allocated to the six multicolor printing units as shown in FIG. 7 are allocated expanding from first areas to fourth areas of both printing cylinders of each printing division according to printing color specification.

As shown in FIG. 7, the print image allocation setting division 8 allocates, from the inputted information, the "pages" to be printed respectively in the respective axial areas 1 to 4 of the right and left printing cylinders of each specified multicolor printing units CT1 to CT6. Next, the print image allocation setting division 8 allocates images to be printed to each printing couple of the specified multicolor printing units CT1, CT2, CT3, CT4, CT5 and CT6 as shown in FIG. 8 for instance. The multicolor printing units CT1, to CT6 shown in FIG. 8 are all arranged in a printable manner from the upstream side of the traveling direction (indicated by an arrow) of the continuous paper W in order of cyan, magenta, yellow and black, and the "0" indicated in the first area of the left printing cylinder L of the printing couple of a cyan printing division P1 of the multicolor printing unit CT1 indicates that there is no image to be printed there, and the "29" indicated in the fourth area of the right printing cylinder R of the printing couple of a black printing division P4 of the multicolor printing unit CT5 indicates that an image of the 29th page is to be printed there. In FIG. 8, all the areas of both the printing cylinders L and R of the printing divisions P1, P2, P3 and P4 of the multicolor printing unit CT6 indicate that there is no image to be printed there.

Moreover, as for setting of the print image allocation information, it is also feasible, for instance, to set print image allocation patterns as shown in FIG. 7 or FIG. 8 in the print image allocation setting division 8 in advance and select and set the print image allocation patterns suited to the printing operation each time printing is carried out.

When setting of the print image allocation information is complete, the master control division 1 for having each driving means MO required for the printing operation synchronously controlled is specified, and the print image allocation information set in the print image allocation setting division 8 is sent to the specified master control division 1 from the print image allocation setting division 8. The print image allocation information shown in FIG. 8 is transmitted in such a manner as "CT1P1L0. 0. 0. 0. R. 0. 0. 0. 0: CT1P2L9. 0. 0. R. 0. 0. 12. 25: CT1P3L9. 0. 0. 0. R. 0. 0. 12. 0: CT1P4L9. 28. 11. 26. R. 10. 27. 12. 25: . . . : CT6P4L0. 0. 0. 0. R. 0. 0. 0. 0." for instance.

The master control division 1 having received the print image allocation information selects and specifies the slave control division 2 for controlling the driving means MO of the printing couple to be controlled in the printing operation based on the print image allocation information.

To be more specific, from the received print image allocation information, the processing division 12 of the master control division 1 checks for each printing division P whether or not there is an image to be printed by that printing division P. And it selects the slave control divisions 2, 2 for individually controlling the driving means MO of two printing couples forming the printing division P having images to be printed.

In the case of receiving the print image allocation information shown in FIG. 8, it acquires for each printing division P a sum of the "numbers" shown in the axial area of each printing cylinder of the two printing couples forming the printing division P, and selects as specified subjects the slave control divisions 2, 2 for individually controlling the driving means MO of two printing couples forming the printing division P of which acquired value is not "0." In addition, it sends to the contact and separation means TP a separation signal for separating the two blanket cylinders BC, BC forming the printing division P of which sum of the "numbers" is "0."

Incidentally, in the case of receiving the print image allocation information shown in FIG. 8, it selects as specified subjects all the slave control divisions 2 except the slave control divisions 2 of #11, #15, #22, #26, #51, #53, #55, #57, #61, #62, #63, #64, #65, #66, #67 and #68 (see FIG. 1) controlling the driving means MO of the printing couples forming the cyan printing division P1 of a multicolor printing unit TC1, a magenta printing division P2 of a multicolor printing unit TC2, the cyan printing division P1 and a yellow printing division P3 of a multicolor printing unit TC5, the cyan printing division P1, the magenta printing division P2, a yellow printing division P3 and a black printing division P4 of a multicolor printing unit TC6.

In addition, the master control division 1 selects and specifies, based on the print image allocation information, the in-feed control division 6 or the out-feed control division 7 or both these control divisions controlling the driving means MO of the in-feed roller IR or the out-feed roller OR or both of them to be controlled by the printing operation.

To be more specific, the processing division 12 of the master control division 1 checks each of the multicolor printing units CT1 to CT6, from the received print image allocation information, as to whether or not the unit has an image to be printed. And as for the multicolor printing unit having an image to be printed, it selects as specified subjects the in-feed control division 6 for controlling the driving means MO of the in-feed roller IR upstream of the first printing division P1 of the multicolor printing unit and the out-feed control division 7 for controlling the driving means MO of the out-feed roller OR downstream of the last printing division P4 of the multicolor printing unit.

In this connection, in the case where the master control division 1 receives the print image allocation information shown in FIG. 8 from the print image allocation setting division 8, it selects as specified subjects all the in-feed control divisions 6 and the out-feed control divisions 7 except the in-feed control division 6 of #60 for controlling the driving means MO of the in-feed roller IR upstream of the first printing division P1 of the multicolor printing unit CT6 and the out-feed control division 7 of #69 for controlling the driving means MO of the out-feed roller OR downstream of the last printing division P4 of the multicolor printing unit CT6.

Furthermore, the master control division 1 selects a width of the continuous paper W required for the printing operation for each of the multicolor printing units CT1 to CT6 based on the print image allocation information. To be more specific, the processing division 12 of the master control division 1 checks each of the multicolor printing units CT1 to CT6, from the received print image allocation information, as to whether or not there is an image to be printed in the first to fourth areas of the left printing cylinder L and the right printing cylinder R respectively. And it recognizes as an unnecessary area of the continuous paper W the first or the fourth area having no image to be printed or any continuous areas including one of them and common in the left printing cylinder L and the right printing cylinder R.

In the case where the above described master control division 1 receives the print image allocation information shown in FIG. 8 from the print image allocation setting division 8, it recognizes as an unnecessary area of the continuous paper W the third and the fourth areas of the multicolor printing unit CT3, and the first to the fourth areas of the multicolor printing unit CT6, and selects as the continuous paper W of the multicolor printing unit CT3, the continuous paper W of half the width of the continuous paper W required by the CT1, CT2, CT4 and CT5 and recognizes the multicolor printing unit CT6 as not requiring the continuous paper W. After completing the above operations, it has the master control division 1 specify the control subject.

Then, the processing division 12 of the master control division 1 sends the message for specifying a management range comprising ASCII code via the master network connection division 17 and the network line 4 to each of slave control divisions 3 of #12, #13, #14, #16, #17, #18, #21, #23, #24, #25, #27, #28, #31, #32, #33, #34, #35, #36, #37, #38, #41, #42, #43, #44, #45, #46, #47, #48, #52, #54, #56, #58 and #99, the in-feed control divisions 6 of #10, #20, #30, #40 and #50, and the out-feed control divisions 7 of #19, #29, #39, #49 and #59 selected as the specification subjects as aforementioned.

Figure 9:
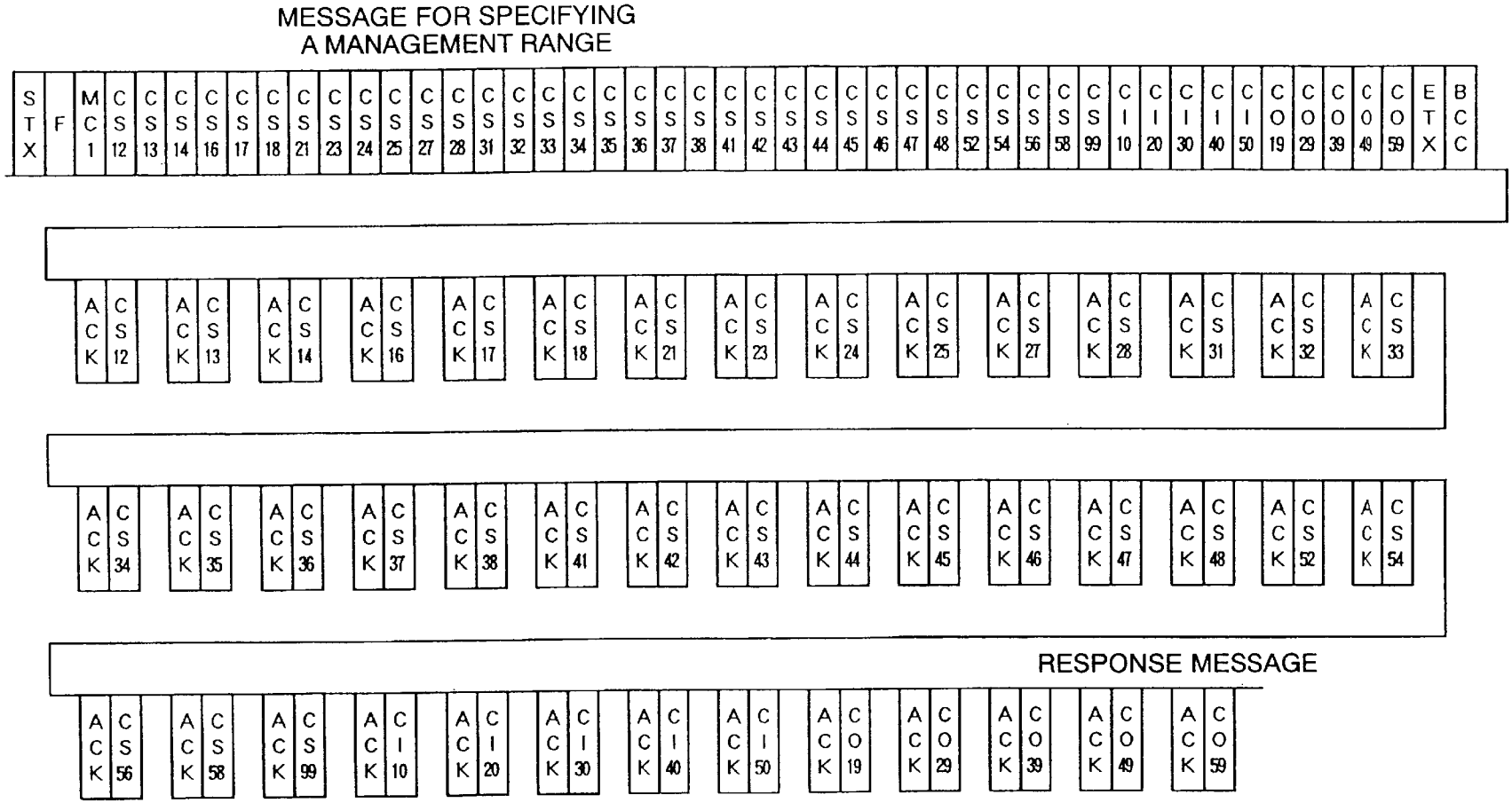
FIG. 9 is a diagram showing an example of configuration of a message for specifying a management range sent by the master control division and a response message of the slave control division.

The message for specifying a management range is, as shown in FIG. 9 for instance, rendered as a text sentence by inserting, between a message start code "STX" and a message end code "ETX," "F" indicating that this message specifies a management range, "MC1" indicating the master control division 1 as the message's origination, "CS12" to "CS58" and "CS99" indicating node numbers of the slave control divisions 3 of #12, #13, #14, #16, #17, #18, #21, #23, #24, #25, #27, #28, #31, #32, #33, #34, #35, #36, #37, #38, #41, #42, #43, #44, #45, #46, #47, #48, #52, #54, #56, #58 and #99 of the driving means MO of the printing couples of the management range, that is, to be controlled, "CI10" to "CI50" indicating the node numbers of the in-feed control divisions 6 of #10, #20, #30, #40 and #50, and "CO19" to "CO59" indicating the node numbers of the out-feed control divisions 7 of #19, #29, #39, #49 and #59 and is constituted by adding a block check "BCC" following the text sentence.

The slave control division 2, the in-feed control division 6 and the out-feed control divisions 7 having received the message for specifying a management range respectively have the slave network connection division 21, the in-feed network connection division 61 and the out-feed network connection divisions 71 of each of them reply to the master control division 1 via the network line 4 with the response message notifying receipt of the message. The response message is comprised of "ACK" indicating that it is a response message and its node number indicating the responding slave control division 3, in-feed control division 6 or out-feed control divisions 7.

Next, the above described processing division 12 renders as the controlling message comprising the ASCII code the width information of the continuous paper W selected for each of the multicolor printing units CT1 to CT5 as described above and sends it to each of the in-feed control divisions 6 of #10, #20, #30, #40 and #50, and each of the out-feed control divisions 7 of #19, #29, #39, #49 and #59 via the master network connection division 17 and the network line 4. This controlling message is sent to the in-feed control divisions 6 or the out-feed control divisions 7 in order while receiving the response messages from the destination in-feed control divisions 6 or out-feed control divisions 7.

Figure 10:
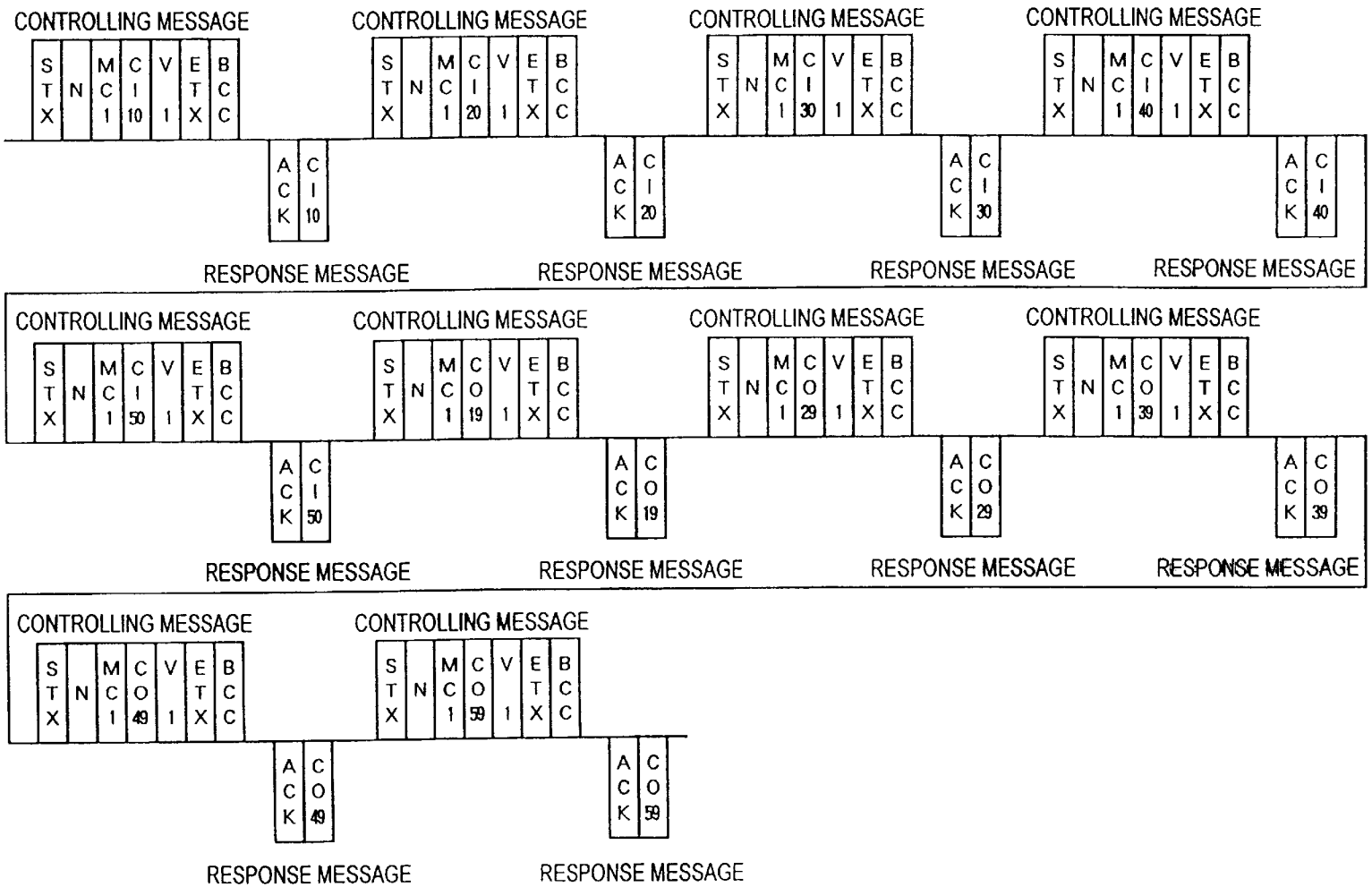
FIG. 10 is a diagram showing an example of configuration of a control message notifying the width of continuous paper sent by the master control division and a response message of the slave control division.

To be more specific, as shown in FIG. 10 for instance, this controlling message is rendered as a text sentence by inserting, between a message start code "STX" and a message end code "ETX," "N" indicating that this message is the width information of the continuous paper W, "MC1 " indicating the master control division 1 as the message's origination, any of "CI10" to "CI50" and "CO19" to "CO59" indicating a destination, and "V1" indicating the width information of the continuous paper W, and is constituted by adding a block check "BCC" following the text sentence.

Here, "4," "3," "2" and "1" of the ASCII code are used for "V1" in the case of the newspaper rotary press capable of printing print images equivalent to four pages of a newspaper arranged side by side in an axial direction of the plate cylinder PC. And the "4," "3," "2" and "1" of the ASCII code are defined to indicate that the width of the continuous paper W is that of the four pages of the newspaper, three pages, two pages and one page respectively.

The in-feed control divisions 6 or the out-feed control divisions 7 to which the controlling message of the width information of the continuous paper W was sent returns to the master control division 1 the response message notifying of the receipt of the controlling message via the in-feed network connection division 61 or the out-feed network connection division 71 respectively. The response message is comprised of the "ACK" indicating that it is the response message and its node number indicating the responding in-feed control divisions 6 or out-feed control divisions 7. And this sending and receiving of the controlling message and the response message are performed in order for each in-feed control divisions 6 or out-feed control divisions 7.

In addition, as described above, each of the in-feed control divisions 6 having received the controlling message of the width information of the continuous paper W has the in-feed tension setting division 63 select the reference tension of the continuous paper W traveling downstream of the in-feed roller IR from the values predetermined corresponding to the width information of the continuous paper W based on that information and set it as the in-feed tension. And in order to set at a value corresponding to the set in-feed tension an output pressure of the air cylinder that is counterforce providing means AC for giving counterforce to go against the traveling tension of the continuous paper W to the dancer roller DR displaced according to the traveling tension of the continuous paper W by way of the in-feed roller IR, it outputs to the electric pneumatic converter 64 the electric power signal corresponding to an input pressure to the above described air cylinder for the sake of acquiring that output pressure.

The electric pneumatic converter 64 adjusts pressure of compressed air to be supplied to the air cylinder that is counterforce providing means AC based on the electric power signal outputted by the in-feed tension setting division 63.

Each of the out-feed control divisions 7 having received the controlling message of the width information of the continuous paper W has the out-feed tension setting division 73 select the reference tension of the continuous paper W traveling upstream of the out-feed roller OR from the values predetermined corresponding to the width information and set it as the out-feed tension and output it to the tension deviation detection division 74.

When the above setting is completed, the rotary press is capable of the printing operation wherein the driving means MO of which management range is specified are synchronously controlled by the master control division 1.

The printing operation by synchronous control is performed first by inputting operation signals such as start, acceleration and deceleration and stop from the input operation division 11 of the master control division 1.

If the operation signals are inputted, the processing division 12 sets the speed value corresponding to the inputted operation signal in the master pulse signal output division 14 of the driving reference setting division 13. Thus, the master pulse signal output division 14 outputs the first master pulse signals corresponding to the set speed and outputs a second master pulse signal each time a predetermined number of the first master pulse signals are outputted. The first and second master pulse signals are the signals of frequencies equal to the pulse signals outputted by the encoder 5 provided corresponding to the driving means MO of each printing couple and Z-phase pulse signals outputted by the encoder 5 when the rotary press is operated at the set speed.

If the master pulse signal output division 14 starts the above described signal output, the speed setting division 15 and the phase setting division 16 of the driving reference setting division 13 totalize the pulse output outputted by the master pulse signal output division 14. To be more specific, the speed setting division 15 totalizes the first master pulse signals, and the totalized value is cleared by the second master pulse signals. The phase setting division 16 totalizes the above described first master pulse signals and the second master pulse signals, and also the totalized value of the first master pulse signals is cleared by the second master pulse signals, and the totalized value of the second master pulse signals is cleared each time the totalized value becomes a predetermined number.

The predetermined number at which the totalized value of the second master pulse signals is cleared is predetermined based on a ratio between the number of revolutions of the driven portion (the plate cylinder PC, for instance) and the number of revolutions of the encoder 5, where for instance, the above described predetermined number is "4" if the encoder 5 revolves four times while the driven portion revolves once, and the above described predetermined number is "1" if the encoder 5 revolves once while the driven portion revolves once. To be more specific, in the latter case, the phase setting division 16 does not necessarily have to calculate the second master pulse signals.

The totalized values of the speed setting division 15 and the phase setting division 16 are sent as the controlling message to the slave control division 2, the in-feed control divisions 6 and the out-feed control divisions 7 that are the management range from the master network connection division 17 via the network line 4 at each predetermined time such as 100 microseconds, for instance.

Figure 11:
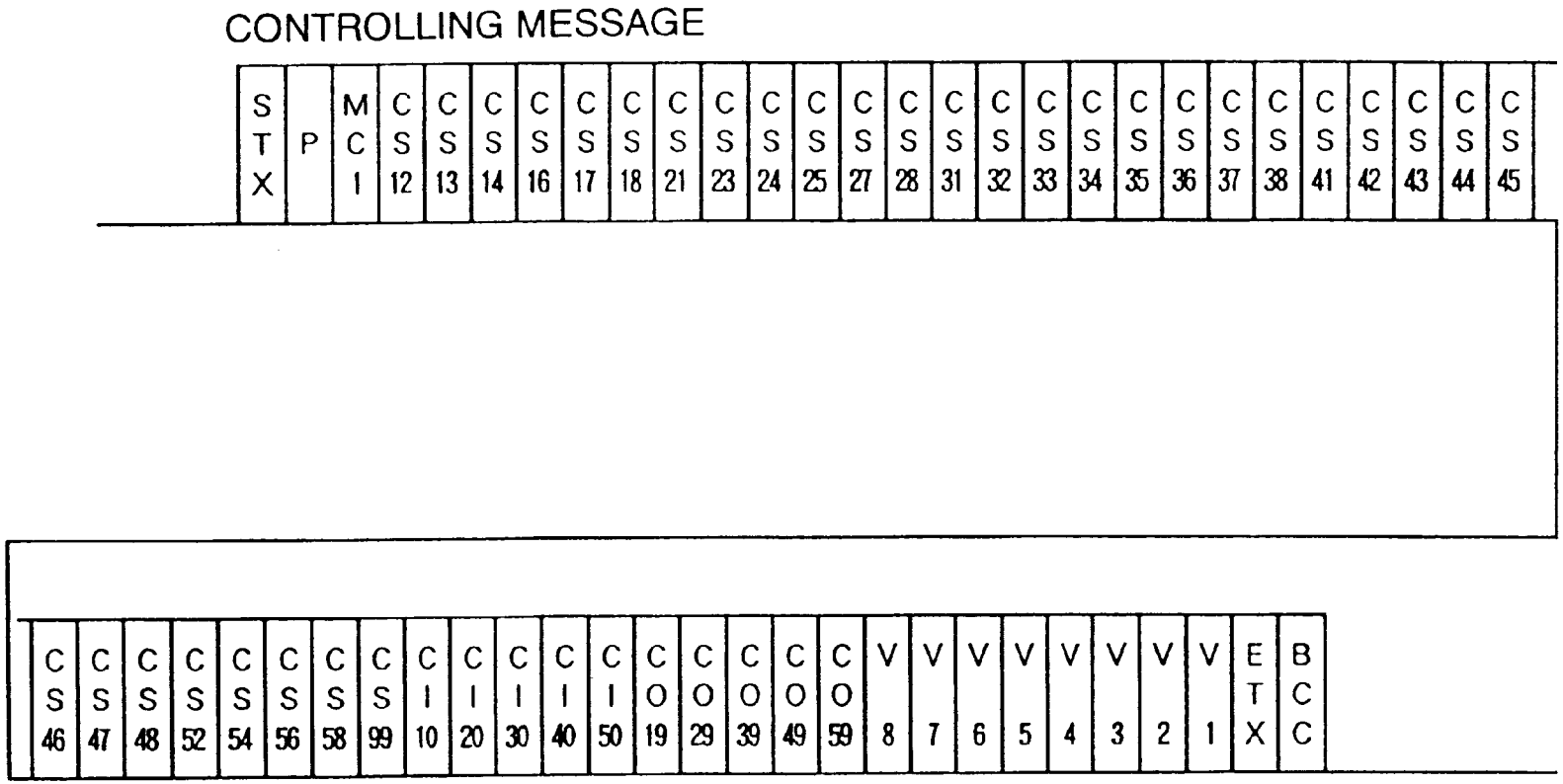
FIG. 11 is a diagram showing an example of configuration of a message for controlling printing operation sent by the master control division.

The controlling message is, as shown in FIG. 11 for instance, rendered as a text sentence by inserting, between a message start code "STX" and a message end code "ETX," "P" indicating that this message is the driving reference, "MC1" indicating the master control division 1 that manages, "CS12" to "CS58" and "CS99" indicating the node numbers of the slave control divisions 2 of each #12, #13, #14, #16, #17, #18, #21, #23, #24, #25, #27, #28, #31, #32, #33, #34, #35, #36, #37, #38, #41, #42, #43, #44, #45, #46, #47, #48, #52, #54, #56, #58 and #99 of the driving means MO of the printing couples and the driving means MO of the folding units FD of the multicolor printing units "CT1," "CT2," "CT3," "CT4" and "CT5," "CI10" to "CI50" indicating the node numbers of the in-feed control divisions 6 of #10, #20, #30, #40 and #50, and "CO19" to "CO59" indicating the node numbers of the out-feed control divisions 7 of #19, #29, #39, #49 and #59, and further "V8" to "V5" indicating the driving reference speed and "V4" to "V1" indicating the driving reference phase, and is constituted by adding a block check "BCC" following the text sentence. Here, "0" to "9" and "A" to "F" of the ASCII code are used for "V8" to "V1," and the driving reference speed and the driving reference phase are both comprised of 4 bytes, for instance, in the exemplified message.

These messages are transmitted on the network line 4 at a speed of 20 megabits per second, for instance.

Each slave control division 2 having received the controlling message has the driving reference speed inputted to the driving reference speed signal output division 22 and the driving reference phase inputted to the driving reference phase signal output division 23 to be processed respectively.

To be more specific, the driving reference speed signal output division 22 to which the driving reference speed was inputted performs the following calculation assuming that the driving reference speed inputted this time is Y2, the driving reference speed inputted immediately before it is Y1, and interval time predetermined for the master control division 1 to send the controlling message is T so as to acquire a value S1 that is proportional to the speed value set by the processing division 12, and multiplies the value S1 by an appropriate constant to output an analog signal corresponding to the product as the driving reference speed signal.

$$S1=(Y2-Y1)/T$$

Moreover, the totalized value of the first master pulse signals of the speed setting division 15 is reset by the second master pulse signals to be Y1>Y2 generating a case of S1<0, in which case S1 is acquired as follows.

$$S1=(Ym+Y2-Y1)/T$$

Ym is an output number of the first master pulse required for the second master pulse signals to be outputted and is a predetermined value.

In addition, each time the driving reference phase is inputted, the driving reference phase signal output division 23 to which the driving reference phase was inputted corrects the phase, as described above, based on a paper feed path length from the printing couple driven by the driving means MO corresponding to the slave control division 2 to the cutting position of the folding unit FD and the assembling phase of the plate cylinder PC of the printing couple and the encoder 5 via the driving means MO, to the extent predetermined so that the print image printed by the printing couple will be in a correct relationship with the position cut by the folding unit FD, and outputs the corrected phase by an appropriate signal as the driving reference phase. Moreover, the driving reference phase signal output division 23 of the slave control division 2 of #99 for controlling the driving means MO of the folding cylinder FC of the folding unit FD outputs the inputted driving reference phase by an appropriate signal as the driving reference phase.

Besides, the slave control division 2 has an output pulse signal of the encoder 5 provided being coupled to the driving means MO corresponding to each slave control division 2 inputted to the feedback signal receiving division 28, and the output pulse signal of the encoder 5 inputted to the feedback signal receiving division 28 is processed by the feedback phase signal output division 27 and the feedback speed signal output division 29 respectively.

The feedback phase signal output division 27 totalizes the pulse signals and the Z-phase pulse signals outputted by the encoder 5, and outputs the totalized value by an appropriate signal as the rotation phase value of the driving means MO. In this totalization of the feedback phase signal output division 27, the totalized value of the pulse signals is cleared by the Z-phase pulse signals, and the totalized value of the Z-phase pulse signals is cleared each time the totalized value becomes a predetermined number. The predetermined number at which the totalized value of the Z-phase pulse signals is cleared is predetermined based on the ratio between the number of revolutions of the driven portion and the number of revolutions of the encoder 5 just as in the case of clearing the totalized value of the second master pulse signals in the phase setting division 16.

In addition, the feedback speed signal output division 29 totalizes the pulse signals and the Z-phase pulse signals outputted by the encoder 5, and performs the following calculation, each time the slave network connection division 21 receives the controlling message, assuming that the totalized value at that time is Y4, the totalized value on receiving the controlling message immediately before it is Y3, and interval time predetermined for the master control division 1 to send the controlling message is T so as to acquire a value S2 that is proportional to the rotating speed of the driving means MO, and multiplies the value S2 by an appropriate constant to output an analog signal corresponding to the product as the driving speed signal.

$$S2=(Y4-Y3)/T$$

Moreover, the totalized value of the pulse signals of the feedback speed signal output division 29 is reset by the Z-phase pulse signals to be Y3>Y4 generating a case of S2<0, in which case S2 is acquired as follows.

$$S2=(Yn+Y4-Y3)/T$$

Yn is a pulse signal output number of the encoder 5 outputted while two prior and subsequent Z-phase pulse signals are outputted, which is the same number as the output number Ym of the first master pulse required for the above described second master pulse signals to be outputted and is a predetermined value.

Furthermore, each time the slave network connection division 21 receives the controlling message, the driving power from the motor driver 31 to the driving means MO is corrected. Its details are as follows.

Each time the slave network connection division 21 receives the controlling message, the driving reference phase signal output division 23 outputs the driving reference phase signal as described above. This driving reference phase signal is inputted to the phase deviation detection division 24. In addition, the phase deviation detection division 24 has the rotation phase value of the driven portion, that is, a feedback phase signal outputted by the feedback phase signal output division 27 inputted.

Each time the driving reference phase signal is inputted, the phase deviation detection division 24 acquires a deviation between the driving reference phase and the rotation phase of the driven portion from the driving reference phase signal and the feedback phase signal, and outputs the acquired deviation to the proportional integral amp that is the phase deviation signal output division 25. Thus, the phase deviation signal output division 25 outputs an analog signal corresponding to the above described inputted deviation as the phase deviation signal.

And the above described driving reference speed signal is corrected by the phase deviation signal in the first speed signal correction division 26 to become the first correction speed signal and then corrected by the driving speed signal in the second speed signal correction division 30 to become the second correction speed signal. And the second correction speed signal is inputted to the motor driver 31.

The motor driver 31 to which the second correction speed signal was inputted corrects the driving power to be supplied to the driving means MO so that it matches the second correction speed signal.

In addition, each in-feed control division 6 having received the controlling message has the driving reference speed inputted to the in-feed driving reference speed signal output division 62 via the in-feed network connection division 61 to be processed.

To be more specific, the in-feed driving reference speed signal output division 62 to which the driving reference speed was inputted performs the following calculation assuming that the driving reference speed inputted this time is Y2, the driving reference speed inputted immediately before it is Y1, and the interval time predetermined for the master control division 1 to send the controlling message is T so as to acquire the value S1 that is proportional to the speed value set by the processing division 12, and multiplies the value S1 by an appropriate constant to output the in-feed driving analog signal corresponding to the product as the in-feed driving reference speed signal.

$$S1=(Y2-Y1)/T$$

Moreover, the totalized value of the first master pulse signals of the speed setting division 15 is reset by the second master pulse signals to be Y1>Y2 generating a case of S1<0, in which case S1 is acquired as follows.

$$S1=(Ym-Y2-Y1)/T$$

Ym is the output number of the first master pulses required for the second master pulse signals to be outputted and is a predetermined value.

On the other hand, as described above, each in-feed control division 6 receives in advance the controlling message of the width information of the continuous paper W by way of the in-feed roller IR corresponding to the in-feed control division 6, which is processed by the in-feed tension setting division 63.

To be more specific, based on the paper width information on the continuous paper W, the in-feed tension setting division 63 selects the reference tension of the continuous paper W traveling downstream of the in-feed roller IR from the values predetermined corresponding to such information, and sets it as the in-feed tension. And in order to set at a value corresponding to the set in-feed tension the output pressure of the air cylinder that is counterforce providing means AC for giving counterforce to go against the traveling tension of the continuous paper W to the dancer roller DR displaced according to the traveling tension of the continuous paper W by way of the in-feed roller IR, it outputs to the electric pneumatic converter 64 the electric power signal corresponding to the input pressure to the above described air cylinder for the sake of acquiring that output pressure. And the electric pneumatic converter 64 adjusts the pressure of the compressed air to be supplied to the air cylinder that is the counterforce providing means AC based on the electric power signal outputted by the in-feed tension setting division 63.

As a result of this adjustment, the dancer roller DR is displaced in the predetermined displacement range according to change of the traveling tension of the continuous paper W by way of the dancer roller DR. This displacement of the dancer roller DR is detected by the detection means PM, and a detected value is inputted to the displacement amplifier 65. The displacement amplifier 65 outputs the voltage signal according to the inputted detected value to the displacement difference signal output division 66.

As the in-feed control division 6 starts control, the displacement difference signal output division 66 has a reference voltage equal to the voltage signal outputted by the displacement amplifier 65 established when the traveling tension of the continuous paper W is in a normal state and the dancer roller DR is not displaced. The displacement difference signal output division 66 acquires the difference between the voltage signal and the reference voltage received from the displacement amplifier 65 each time the driving reference phase signal is inputted, and outputs the displacement difference signal corresponding to the difference as an analog signal that is the same as the in-feed driving reference speed signal.

The above-described in-feed driving reference speed signal is corrected by the displacement difference signal and rendered as a correction in-feed speed signal in the in-feed speed signal correction division 67, and the correction in-feed speed signal is inputted to the motor driver 68.

The motor driver 68 to which the correction in-feed speed signal was inputted corrects the driving power to be supplied to the driving means MO so that it matches the correction in-feed speed signal.

In addition, each out-feed control division 7 having received the controlling message has the driving reference speed inputted to the out-feed driving reference speed signal output division 72 via the out-feed network connection division 71 to be processed.

To be more specific, the out-feed driving reference speed signal output division 72 to which the driving reference speed was inputted performs the following calculation assuming that the driving reference speed inputted this time is Y2, the driving reference speed inputted immediately before it is Y1, and the interval time predetermined for the master control division 1 to send the controlling message is T so as to acquire the value S1 that is proportional to the speed value set by the processing division 12, and multiplies the value S1 by an appropriate constant to output the out-feed driving analog signal corresponding to the product as the out-feed driving reference speed signal.

$$S1=(Y2-Y1)/T$$

Moreover, the totalized value of the first master pulse signals of the speed setting division 15 is reset by the second master pulse signals to be Y1>Y2 generating a case of S1<0, in which case S1 is acquired as follows.

$$S1=(Ym+Y2-Y1)/T$$

Ym is the output number of the first master pulses required for the second master pulse signals to be outputted and is a predetermined value.

On the other hand, as described above, each out-feed control division 7 receives in advance the controlling message of the width information of the continuous paper W byway of the out-feed roller OR corresponding to the out-feed control division 7, which is processed by the out-feed tension setting division 73.

To be more specific, based on the paper width information on the continuous paper W, the out-feed tension setting division 73 selects the reference tension of the continuous paper W traveling upstream of the out-feed roller OR from the values predetermined corresponding to such information, and sets it as the out-feed tension and outputs it to the tension deviation detection division 74.

Furthermore, the tension deviation detection division 74 has the traveling tension of the continuous paper W traveling upstream of the out-feed roller OR detected by the tension detection means PU annexed to the tension detection roller TR inputted. Each time the driving reference phase signal is inputted, the tension deviation detection division 74 acquires a deviation between the reference tension inputted by the out-feed tension setting division 73 and the traveling tension of the continuous paper W detected by the tension detection means PU, and outputs the acquired deviation to the integral amp that is the tension deviation signal output division 75. Thus, the tension deviation signal output division 75 outputs an analog signal that is the same as the out-feed driving reference speed signal corresponding to the above described inputted deviation as the tension deviation signal.

And the above described out-feed driving reference speed signal is corrected by the tension deviation signal in the out-feed speed signal correction division 76 to become a correction out-feed speed signal, and the correction out-feed speed signal is inputted to the motor driver 77.

The motor driver 77 to which the correction out-feed speed signal was inputted corrects the driving power to be supplied to the driving means MO so that it matches the correction out-feed speed signal.

According to the control described above, each driven portion to be controlled by the master control division 1 as its management range is specified based on print image information, and the driving means MO of the printing couple has its rotation phase matched so that the printing cylinders as the driven portion will be in a predetermined relationship with the rotation phase of the folding cylinder FC of the folding unit FD, and also synchronous operation wherein the rotating speed is matched is performed. In addition, the reference tension of the continuous paper W traveling downstream of the in-feed roller IR and the reference tension of the continuous paper W traveling upstream of the out-feed roller OR are set based on the print image information, and the rotation of the driving means MO driving the in-feed roller IR and the out-feed roller OR is controlled so that the traveling tension of the continuous paper W is kept at the reference tension.

As described above, when performing the printing operation by using the rotary press having several multicolor printing units, the present invention is capable of, based on the print image information required by any means in advance of the printing operation, automatically selecting a printing division not required to operate, that is, the printing division that may be stopped and excluding it from subjects of synchronous operation control, and thus it is extremely effective in terms of energy saving, reduction of running costs and improvement in work safety.

In addition, as the printing division not required to operate is securely selected and specification of the printing division to be specified is never forgotten, there is no longer inconvenience such as faulty printed matter and trouble in the printing process and besides, there is no longer any slowdown of the work.

Furthermore, it is capable of recognizing a width dimension of the continuous paper required by each multicolor printing unit based on the print image information, and automatically setting the reference tension on traveling of the continuous paper in advance of the printing operation based on this recognition, having the continuous paper travel stably from a start of printing operation according to the reference tension, and preventing malfunctions such as a paper drift wherein the continuous paper moves from side to side while traveling due to an unstable tension, occurrence of wrinkles in the traveling direction and paper out, so that occurrence of reduction in printing quality, occurrence of broke and reduction in work efficiency due to adjustments for recovery and maintenance can be prevented.

What is claimed is:

1. A synchronous controller of a rotary press for selecting control subjects based on print image information, the rotary press having a plurality of multicolor printing units combining at least two of blanket to blanket printing divisions in which a blanket cylinder of a printing couple combining a plate cylinder and the blanket cylinder in a contactable manner is placed in a contactable manner with a blanket cylinder of another printing couple for printing a print image on the plate cylinder onto continuous paper passing between the two blanket cylinders via the blanket cylinders, for using and printing on the continuous paper in each of these multicolor printing units, comprising:

a print image allocation setting division for allocating to each printing couple a print image to be printed by the printing couple, by inputting, at least, unit specification information that specifies multicolor printing units and a folding unit to be specified, page number information that specifies the total number of pages of the newspaper to be specified and printing color information that specifies the printing color of each page;

driving means provided to each printing couple for individually driving each printing couple;

a slave control division provided to each driving means for controlling rotation of the driving means;

one or more master control divisions provided by connecting with each slave control division and print image allocation setting division; and contact and separation means for, on receiving a separation signal from the master control division, separating the two blanket cylinders of the printing division, wherein the master control division specifies the slave control division to be managed based on information of the print image allocation setting division and sends a control reference signal to the specified slave control division.

2. A synchronous controller of a rotary press for selecting control subjects based on print image information, the rotary press having a plurality of multicolor printing units combining at least two of blanket to blanket printing divisions in which a blanket cylinder of a printing couple combining a plate cylinder and the blanket cylinder in a contactable manner is placed in a contactable manner with a blanket cylinder of another printing couple for printing a print image on the plate cylinder onto continuous paper passing between the two blanket cylinders via the blanket cylinders, for using and printing on, in each of these multicolor printing units, the continuous paper of a width dimension selected from the predetermined continuous paper of several width dimensions according to a print image area of the multicolor printing unit, comprising:

a print image allocation setting division for allocating to each printing couple a print image to be printed by the printing couple, by inputting, at least, unit specification information that specifies multicolor printing units and a folding unit to be specified, page number information that specifies the total number of pages of the newspaper to be specified and printing color information that specifies the printing color of each page;

driving means provided to each printing couple for individually driving each printing couple;

an in-feed roller corresponding to each multicolor printing unit and rotated and driven by individual driving means to feed the multicolor printing unit with the continuous paper;

a dancer roller corresponding to each multicolor printing unit and displaced according to traveling tension of the continuous paper fed into the multicolor printing unit and a force set to go against the traveling tension;

a slave control division provided to each driving means for controlling rotation of the driving means;

an in-feed control division for controlling the rotation and driving of the in-feed roller according to the displacement of the dancer roller;

one or more master control divisions provided by connecting with each slave control division, each in-feed control division and each print image allocation setting division; and contact and separation means for, on receiving a separation signal from the master control division, separating the two blanket cylinders of the printing division, wherein the master control division specifies the slave control division and the in-feed control division to be managed based on allocation information of the print image allocation setting division and sends a control reference signal to the specified slave control division and sends to the specified in-feed control division a signal for setting the force to go against the traveling tension of the dancer roller corresponding to the continuous paper of a width dimension selected according to the print image area based on the allocation information of the print image allocation setting division.

3. A synchronous controller of a rotary press for selecting control subjects based on print image information, the rotary press having a plurality of multicolor printing units combining at least two of blanket to blanket printing divisions in which a blanket cylinder of a printing couple combining a plate cylinder and the blanket cylinder in a contactable manner is placed in a contactable manner with a blanket cylinder of another printing couple for printing a print image on the plate cylinder onto continuous paper passing between the two blanket cylinders via the blanket cylinders, for using and printing on, in each of these multicolor printing units, the continuous paper of a width dimension selected from the predetermined continuous paper of several width dimensions according to a print image area of the multicolor printing unit, comprising:

a print image allocation setting division for allocating to each printing couple a print image to be printed by the printing couple, by inputting, at least, unit specification information that specifies multicolor printing units and a folding unit to be specified, page number information that specifies the total number of pages of the newspaper to be specified and printing color information that specifies the printing color of each page;

driving means provided to each printing couple for individually driving each printing couple;

an out-feed roller corresponding to each multicolor printing unit and rotated and driven by individual driving means to draw the continuous paper out of the multicolor printing unit;

a tension detection roller corresponding to each multicolor printing unit and detecting the traveling tension of the continuous paper drawn out of the multicolor printing unit;

a slave control division provided to each driving means for controlling rotation of the driving means;

an out-feed control division for controlling the rotation and driving of the out-feed roller according to the traveling tension of the continuous paper detected by the tension detection roller;

one or more master control divisions provided by connecting with each slave control division, each out-feed control division and each print image allocation setting division; and contact and separation means for, on receiving a separation signal from the master control division, separating the two blanket cylinders of the printing division, wherein the master control division specifies the slave control division and the out-feed control division to be managed based on allocation information of the print image allocation setting division and sends a control reference signal to the specified slave control division and sends to the specified out-feed control division a signal for setting the detection tension of the tension detection roller for controlling rotation and driving of the out-feed roller corresponding to the continuous paper of a width dimension selected according to the print image area based on the allocation information of the print image allocation setting division.

4. A synchronous controller of a rotary press for selecting control subjects based on print image information, the rotary press having a plurality of multicolor printing units combining at least two of blanket to blanket printing divisions in which a blanket cylinder of a printing couple combining a plate cylinder and the blanket cylinder in a contactable manner is placed in a contactable manner with a blanket cylinder of another printing couple for printing a print image on the plate cylinder onto continuous paper passing between the two blanket cylinders via the blanket cylinders, for using and printing on, in each of these multicolor printing units, the continuous paper of a width dimension selected from the predetermined continuous paper of several width dimensions according to a print image area of the multicolor printing unit, comprising:

a print image allocation setting division for allocating to each printing couple a print image to be printed by the printing couple, by inputting, at least, unit specification information that specifies multicolor printing units and a folding unit to be specified, page number information that specifies the total number of pages of the newspaper to be specified and printing color information that specifies the printing color of each page;

driving means provided to each printing couple for individually driving each printing couple;

an in-feed roller corresponding to each multicolor printing unit and rotated and driven by individual driving means to feed the multicolor printing unit with the continuous paper;

a dancer roller corresponding to each multicolor printing unit and displaced according to traveling tension of the continuous paper fed into the multicolor printing unit and a force set to go against the traveling tension;

an out-feed roller corresponding to each multicolor printing unit and rotated and driven by individual driving means to draw the continuous paper out of the multicolor printing unit;

a tension detection roller corresponding to each multicolor printing unit and detecting the traveling tension of the continuous paper drawn out of the multicolor printing unit;

a slave control division provided to each driving means for controlling rotation of the driving means;

an in-feed control division for controlling the rotation and driving of the in-feed roller according to the displacement of the dancer roller;

an out-feed control division for controlling the rotation and driving of the out-feed roller according to the traveling tension of the continuous paper detected by the tension detection roller;

one or more master control divisions provided by connecting with each slave control division, each in-feed control division, each out-feed control division and each print image allocation setting division; and contact and separation means for, on receiving a separation signal from the master control division, separating the two blanket cylinders of the printing division, wherein the master control division specifies the slave control division, the in-feed control division and the out-feed control division to be managed based on allocation information of the print image allocation setting division and the master control division sends a control reference signal to the specified slave control division, the master control division sends to the specified in-feed control division a signal for setting the force to go against the traveling tension of the dancer roller corresponding to the continuous paper of a width dimension selected according to the print image area based on the allocation information of the print image allocation setting division, and the master control division sends to the specified out-feed control division a signal for setting the detection tension of the tension detection roller for controlling rotation of the out-feed roller corresponding to the continuous paper of a width dimension selected according to the print image area based on the allocation information of the print image allocation setting division.

5. The synchronous controller of the rotary press for selecting control subjects based on print image information according to any one of claims 1 to 4, wherein, in the case where a plurality of said master control divisions are provided, each master control division has the same functions and any one of said master control divisions can be selectively switched into and out of control of the rotary press.

6. The synchronous controller of the rotary press for selecting control subjects based on print image information according to claim 1, wherein said master control division and said slave control division are connected on a network line in a loop respectively.

7. The synchronous controller of the rotary press for selecting control subjects based on print image information according to any one of claims 1 to 4, wherein said print image allocation setting division has, from inputted information, information on allocation of pages to be printed respectively and allocation of print images to be printed on each printing couple of a specified multicolor printing unit set in respective axial areas of the right and left printing cylinders of each specified multicolor printing unit.

8. The synchronous controller of the rotary press for selecting control subjects based on print image information according to claim 7, wherein said print image allocation information is set by selecting and specifying an allocation pattern suited to printing operation from the print image allocation patterns prepared in advance in the print image allocation setting division.

9. The synchronous controller of the rotary press for selecting control subjects based on print image information according to claim 1, wherein said master control division has an input operation division for inputting information required for operating the rotary press and so on, a driving reference setting division for setting a driving reference phase and a driving reference speed, a processing division for processing information inputted from the input operation division and the print image allocation setting division to operate other components, generating an separation signal for separating two blanket cylinders excluded from the operation control subjects and managing sending and receiving of information to and from the slave control division, and a master network connection division for sending and receiving information to and from the processing division and the slave control division.

10. The synchronous controller of the rotary press for selecting control subjects based on print image information according to claim 9, wherein said processing division for each printing division the sum of "numbers" of values based on whether or not there is an image to be printed in each predetermined corresponding area shown in the axial area of each printing cylinder of the two printing couples forming the printing division from the received print image allocation information, selects as specification subjects two slave control divisions for individually controlling driving means of two printing couples forming the printing division of which acquired value is not "0," and generates a separation signal for separating said two blanket cylinders forming the printing division of which said sum of "numbers" is "0."

11. The synchronous controller of the rotary press for selecting control subjects based on print image information according to any one of claims 1 to 4, wherein said slave control division has a slave network connection division for sending and receiving information from and to the master control division, said slave control division has a driving reference speed signal output division for converting the driving reference speed of a controlling message into the driving reference speed signal in proportion to a speed value set by the processing division based on an input signal inputted from the input operation division, said slave control division has a driving reference phase signal output division for, each time the driving reference phase of the controlling message is inputted, correcting the phase, based on a paper feed path length from the printing couple driven by the driving means corresponding to the slave control division to a cutting position of the folding unit and an assembling phase of the plate cylinder of the printing couple and the encoder via the driving means, so that the print image printed by the printing couple will be in a correct relationship with the position cut by the folding unit, and outputting the corrected phase as a driving reference phase, said slave control division has a feedback signal receiving division for receiving a pulse signal and a Z-phase pulse signal outputted by the encoder corresponding to the driving means, said slave control division has a feedback speed signal output division for converting them into driving speed signals in proportion to the rotating speed of the driving means, said slave control division has a feedback phase signal output division for detecting a rotation phase of a plate cylinder of a driven portion, said slave control division has a phase deviation detection division for detecting a deviation of a printing cylinder phase against a driving reference phase from the driving reference phase signal outputted by the driving reference phase signal output division and a phase signal of the feedback phase signal output division, said slave control division has a phase deviation signal output division for converting the deviation detected by the phase deviation detection division into a phase deviation signal, said slave control division has a first speed signal correction division for correcting the driving reference speed signal of the driving reference speed signal output division by the phase deviation signal of the phase deviation signal output division, said slave control division has a second speed signal correction division for correcting a first correction speed signal after being corrected in the first speed signal correction division by the driving speed signal of the driving means outputted by the feedback speed signal output division, and said slave control division has a motor driver.

12. The synchronous controller of the rotary press for selecting control subjects based on print image information according to claim 2, wherein said master control division, the slave control division and the in-feed control division are connected on a network line in a loop-like manner respectively.

13. The synchronous controller of the rotary press for selecting control subjects based on print image information according to claim 3, wherein said master control division, the slave control division and the out-feed control division are connected on a network line in a loop-like manner respectively.

14. The synchronous controller of the rotary press for selecting control subjects based on print image information according to claim 4, wherein said master control division, the slave control division, the in-feed control division and the out-feed control division are connected on a network line in a loop-like manner respectively.

15. The synchronous controller of the rotary press for selecting control subjects based on print image information according to claim 4, wherein said master control division has an input operation division for inputting information required for operating the rotary press and so on, a driving reference setting division for setting a driving reference phase and a driving reference speed, a processing division for processing information inputted from the input operation division and the print image allocation setting division to operate other components, generating a separation signal for separating two blanket cylinders excluded from the operation control subjects and also selecting a width of the continuous paper to be printed by each multicolor printing unit to be controlled, and managing sending and receiving of information to and from the slave control division, the out-feed control division and the in-feed control division, and a master network connection division for sending and receiving information to and from the processing division, the slave control division, the out-feed control division and the in-feed control division respectively.

16. The synchronous controller of the rotary press for selecting control subjects based on print image information according to claim 15, wherein said processing division acquires for each printing division the sum of values based on whether or not there is an image to be printed in each predetermined corresponding area shown in the axial area of each printing cylinder of the two printing couples forming the printing division from the received print image allocation information, selects as specification subjects two slave control divisions for individually controlling the driving means of two printing couples forming the printing division of which acquired value is not "0," and generates a separation signal for separating said two blanket cylinders forming the printing division of which said sum of "numbers" is "0."

17. The synchronous controller of the rotary press for selecting control subjects based on print image information according to claim 15, wherein said processing division recognizes, from print image allocation information, an unnecessary area of the continuous paper based on whether or not there is an image to be printed by checking it in each predetermined corresponding area of the right and left printing cylinders for each multicolor printing unit, and also selecting a paper width of the continuous paper required as the continuous paper of the multicolor printing unit.

18. The synchronous controller of the rotary press for selecting control subjects based on print image information according to claim 15, wherein said processing division organizes a set of the rotary press for printing operation and creates a message for specifying a management range based on allocation information from the print image allocation setting division, and also creates a controlling message related to width information of the continuous paper to be printed by each multicolor printing unit selected by the processing division and a driving reference value set by the driving reference setting division and so on.

19. The synchronous controller of the rotary press for selecting control subjects based on print image information according to claim 2 or 4, wherein said in-feed control division has an in-feed network connection division for sending and receiving information to and from the master control division, an in-feed driving reference speed signal output division for converting driving reference speed of the controlling message into the driving reference speed signal in proportion to the speed value set by the processing division based on an input signal inputted from the input operation division, an in-feed tension setting division for selecting, based on the received paper width information on the continuous paper, a reference tension of the continuous paper traveling downstream of the in-feed roller from values predetermined corresponding to the paper width information and setting it as an in-feed tension, and in order to set at a value corresponding to the set in-feed tension an output pressure of counterforce providing means for giving counterforce to go against the traveling tension of the continuous paper to the dancer roller displaced according to the traveling tension of the continuous paper by way of the in-feed roller, outputting an electric power signal corresponding to an input pressure for the sake of acquiring that output pressure, an electric pneumatic converter for adjusting pressure of compressed air to be supplied to the counterforce providing means based on the electric power signal outputted by the in-feed tension setting division, a displacement amplifier for receiving a displacement signal from the detection means for detecting a displacement amount of the in-feed roller arising from a difference between the traveling tension of the continuous paper traveling downstream of the in-feed roller and the in-feed tension set by the in-feed tension setting division, and outputting an amplified voltage signal commensurate therewith, a displacement difference signal output division for comparing an output signal of the displacement amplifier with the amplified voltage signal commensurate with the displacement signal of the detection means when the in-feed roller is at a reference position and outputting the difference as a displacement difference signal, an in-feed speed signal correction division for correcting the driving reference speed signal of the in-feed driving reference speed signal output division by the displacement difference signal of the displacement difference signal output division, and a motor driver.

20. The synchronous controller of the rotary press for selecting control subjects based on print image information according to claim 3 or 4, wherein said out-feed control division has an out-feed network connection division for sending and receiving information to and from the master control division, an out-feed driving reference speed signal output division for converting the driving reference speed of a received controlling message into the driving reference speed signal of the speed value set by the processing division based on an input signal inputted from the input operation division, an out-feed tension setting division for selecting, based on the received paper width information on the continuous paper W, a reference tension of the continuous paper traveling upstream of the out-feed roller from values predetermined corresponding to the paper width information and setting it as an out-feed tension and outputting it by an appropriate signal, a tension deviation detection division for detecting, from the out-feed tension of the out-feed tension setting division and the traveling tension of the continuous paper traveling upstream of the out-feed roller detected by the tension detection means annexed to the tension detection roller, a deviation of the traveling tension of the continuous paper traveling upstream of the out-feed roller against the out-feed tension, a tension deviation signal output division for converting the deviation detected by the tension deviation detection division into the tension deviation signal, an out-feed speed signal correction division for correcting the driving reference speed signal of the out-feed driving reference speed signal output division by the tension deviation signal outputted by the tension deviation signal output division, and a motor driver.

21. The synchronous controller of the rotary press for selecting control subjects based on print image information according to claim 18, wherein said message for specifying a management range is rendered as a text sentence by inserting, between a message start code "STX" and a message end code "ETX," "F" indicating that this message specifies a management range, an "MC number" indicating a master control division as the message's origination, "CS numbers" indicating node numbers of the slave control divisions of driving means of printing couples of the management range, that is, to be controlled, "CI numbers" indicating the node numbers of in-feed control divisions, and "CO numbers" indicating the node numbers of out-feed control divisions, and is constituted by adding a block check "BCC" following the text sentence.

22. The synchronous controller of the rotary press for selecting control subjects based on print image information according to claim 21, wherein the slave control divisions, the in-feed control divisions and the out-feed control divisions having received said message for specifying a management range return to the master control division as the message's origination the response message notifying the receipt of the message for specifying a management range.

23. The synchronous controller of the rotary press for selecting control subjects based on print image information according to claim 22, wherein said response message is comprised of "ACK" indicating that it is a response message, a control division name "CS," "CI" or "CO" indicating the responding slave control division, in-feed control division or out-feed control divisions and its node number.

24. The synchronous controller of the rotary press for selecting control subjects based on print image information according to claim 18, wherein said controlling message is rendered as a text sentence by inserting, between a message start code "STX" and a message end code "ETX," "N" indicating that this message is paper width information on the continuous paper W, an "MC number" indicating the master control division as the message's origination, either a "CI number" or a "CO number" indicating a destination, and "V1" indicating the paper width information on the continuous paper, and is constituted by adding a block check "BCC" following the text sentence.

25. The synchronous controller of the rotary press for selecting control subjects based on print image information according to claim 24, wherein each in-feed control divisions or out-feed control division to which said controlling message of width information of the continuous paper is sent returns to the master control division as the message's origination the response message notifying the receipt of the controlling message of width information of the continuous paper.

26. The synchronous controller of the rotary press for selecting control subjects based on print image information according to claim 25, wherein said response message is comprised of "ACK" indicating that it is a response message, a control division name "CI," or "CO" indicating the responding in-feed control division or out-feed control divisions and its node number.

27. The synchronous controller of the rotary press for selecting control subjects based on print image information according to claim 2 or 4, wherein said dancer roller has detection means for detecting displacement thereof provided.

28. The synchronous controller of the rotary press for selecting control subjects based on print image information according to claim 27, wherein said means for detecting displacement of the dancer roller is a potentiometer.

29. The synchronous controller of the rotary press for selecting control subjects based on print image information according to claim 4, wherein said multicolor printing unit has an in-feed roller upstream of a first printing division and an out-feed roller downstream of a last printing division respectively, and each in-feed roller or out-feed roller is driven by individual driving means.

30. The synchronous controller of the rotary press for selecting control subjects based on print image information according to claim 29, wherein, between said in-feed roller and the first printing division, a dancer roller is provided and it is given by counterforce providing means a force to go against the traveling tension of the continuous paper fed by the in-feed roller into the multicolor printing units, and is displaced according to the traveling tension of the continuous paper and the predetermined counterforce thereto.

31. The synchronous controller of the rotary press for selecting control subjects based on print image information according to claim 30, wherein said counterforce providing means is an air cylinder.

32. The synchronous controller of the rotary press for selecting control subjects based on print image information according to claim 29, wherein, between said out-feed roller and the last printing division, a tension detection roller is provided and it has tension detection means annexed so as to detect the traveling tension of the continuous paper drawn out of each multicolor printing unit by the out-feed roller.

33. A controller for a printing press with a plurality of printing units where each printing unit includes a plurality of printing groups, each printing group having a plurality of printing cylinders, said printing cylinders of each printing unit printing on a continuous web, the controller comprising:

a print image module generating an allocating signal allocating to each printing cylinder a print image to be printed by said each printing cylinder;

driving means connectable to said each printing group for individually driving said each printing group;

a plurality of slave modules, each said slave module being connected to one of said driving means for controlling rotation of said printing cylinders;

contact and separation means for separating the printing cylinders of said printing groups based a separation signal;

a master module connected to said each slave module and receiving said allocation signal from said print image module, said master module controlling said printing cylinders through said slave modules based on said allocation signal, said master module controlling said contact and separation means based on said allocation signal.

* * * * *